US010788251B2

(12) United States Patent
Boarman et al.

(10) Patent No.: US 10,788,251 B2
(45) Date of Patent: Sep. 29, 2020

(54) TWIST HARVEST ICE GEOMETRY

(71) Applicant: WHIRLPOOL CORPORATION, Benton Harbor, MI (US)

(72) Inventors: Patrick J. Boarman, Evansville, IN (US); Mark E. Thomas, Corydon, IN (US); Lindsey A. Wohlgamuth, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 170 days.

(21) Appl. No.: 15/720,452

(22) Filed: Sep. 29, 2017

(65) Prior Publication Data

US 2018/0023873 A1 Jan. 25, 2018

Related U.S. Application Data

(63) Continuation of application No. 15/357,633, filed on Nov. 21, 2016, now Pat. No. 9,816,744, which is a (Continued)

(51) Int. Cl.
*F25C 1/20* (2006.01)
*F25C 5/06* (2006.01)
(Continued)

(52) U.S. Cl.
CPC ..... *F25C 1/20* (2013.01); *F25B 21/02* (2013.01); *F25C 1/10* (2013.01); *F25C 1/18* (2013.01);
(Continued)

(58) Field of Classification Search
CPC ..... F25C 1/10; F25C 1/18; F25C 1/20; F25C 1/246; F25C 5/06; F25C 2305/022; F25B 21/02; F25D 23/04
See application file for complete search history.

(56) References Cited

U.S. PATENT DOCUMENTS 275,192 A 4/1883 Goodell
286,604 A 10/1883 Goodell
(Continued)

FOREIGN PATENT DOCUMENTS

AU 2006201786 A1 11/2007
CN 1989379 A 6/2007
(Continued)

OTHER PUBLICATIONS

"Manufacturing Processes—Explosive Sheetmetal Forming," Engineer's Handbook, 2006, web archive, last accessed Jan. 19, 2016, at http://www.engineershandbook.com/MfgMethods/exforming.htm, pp. 1-3.

(Continued)

*Primary Examiner* — Frantz F Jules
*Assistant Examiner* — Martha Tadesse
(74) *Attorney, Agent, or Firm* — Price Heneveld LLP

(57) ABSTRACT

An ice maker assembly includes an ice making apparatus for an appliance with an ice making tray having a water basin formed by a metallic ice forming plate and at least one perimeter sidewall extending upwardly from a top surface of the ice forming plate. The ice making tray also has a grid with at least one dividing wall. The at least one perimeter sidewall and the at least one dividing wall and the top surface of the ice forming plate form at least one ice compartment having an upper surface and a lower surface. An ice body is formed in the at least one ice compartment. Moreover, the at least one perimeter sidewall and the at least one dividing wall form a draft angle with the top surface of the ice forming plate, of about 17 degrees to about 25 degrees.

5 Claims, 18 Drawing Sheets

Related U.S. Application Data continuation of application No. 13/713,228, filed on Dec. 13, 2012, now Pat. No. 9,500,398.

(51) Int. Cl.

| | |
|---|---|
| ***F25C 1/18*** | (2006.01) |
| ***F25C 1/10*** | (2006.01) |
| ***F25B 21/02*** | (2006.01) |
| ***F25C 1/246*** | (2018.01) |
| *F25D 23/04* | (2006.01) |

(52) U.S. Cl.

CPC ..... *F25C 1/246* (2013.01); *F25C 5/06* (2013.01); *F25C 2305/022* (2013.01); *F25C 2400/10* (2013.01); *F25C 2500/02* (2013.01); *F25D 23/04* (2013.01)

(56) References Cited

U.S. PATENT DOCUMENTS 301,539 A 7/1884 Vezin
1,407,614 A 2/1922 Wicks
1,616,492 A 2/1927 Lado
1,889,481 A 11/1932 Kennedy, Jr.
1,932,731 A 10/1933 Hathome
2,027,754 A 1/1936 Smith
2,244,081 A 3/1938 Reeves
2,617,269 A 6/1949 Smith-Johannsen
2,481,525 A 9/1949 Mott
2,757,519 A 2/1954 Sampson
2,846,854 A 2/1954 Galin
2,683,356 A 7/1954 Green, Jr.
2,878,659 A 7/1955 Prance et al.
2,942,432 A 6/1960 Muffiy
2,969,654 A 1/1961 Harle
2,996,895 A 8/1961 Lippincott
3,009,336 A 11/1961 Bayston et al.
3,016,719 A 1/1962 Reindl
3,033,008 A 5/1962 Davis
3,046,753 A 7/1962 Carapico, Jr.
3,071,933 A 1/1963 Shoemaker
3,075,360 A 1/1963 Elfving et al.
3,075,364 A 1/1963 Kniffin
3,077,748 A * 2/1963 Deutgen ..... F25C 1/246 249/128
3,084,678 A 4/1963 Lindsay
3,084,878 A 4/1963 Helming et al.
3,093,980 A 6/1963 Frei
3,144,755 A 8/1964 Kattis
3,159,985 A 12/1964 Keighley
3,172,269 A 3/1965 Cole
3,192,726 A 7/1965 Newton
3,200,600 A 8/1965 Elfving
3,214,128 A 10/1965 Beck et al.
3,217,508 A 11/1965 Beck et al.
3,217,510 A 11/1965 Kniftin et al.
3,217,511 A 11/1965 Keighley
3,222,902 A 12/1965 Brejcha et al.
3,228,222 A 1/1966 Maier
3,255,603 A 6/1966 Johnson et al.
3,306,064 A 2/1967 Poolos
3,308,631 A 3/1967 Kniffin
3,318,105 A 5/1967 Burroughs et al.
3,321,932 A 5/1967 Orphey, Jr.
3,383,876 A 5/1968 Frohbieter
3,412,572 A 11/1968 Kesling
3,426,564 A 2/1969 Jansen et al.
3,451,237 A 6/1969 Baringer et al.
3,596,477 A 8/1971 Harley
3,638,451 A 2/1972 Brandt
3,646,792 A 3/1972 Hertel et al.
3,648,964 A 3/1972 Fox
3,677,030 A 7/1972 Nicholas
3,684,235 A 8/1972 Schupbach
3,775,992 A 12/1973 Bright
3,788,089 A 1/1974 Graves
3,806,077 A 4/1974 Pietrzak et al.
3,864,933 A 2/1975 Bright
3,892,105 A * 7/1975 Bernard ..... F25C 5/06 62/353
3,908,395 A 9/1975 Hobbs
3,952,539 A 4/1976 Hanson et al.
4,006,605 A 2/1977 Dickson et al.
D244,275 S 5/1977 Gurbin
4,024,744 A 5/1977 Trakhtenberg et al.
4,059,970 A 11/1977 Loeb
4,062,201 A 12/1977 Schumacher et al.
4,078,450 A 3/1978 Vallejos
D249,269 S 9/1978 Pitts
4,142,378 A 3/1979 Bright et al.
4,148,457 A 4/1979 Gurbin
4,184,339 A 1/1980 Wessa
4,222,547 A 9/1980 Lalonde
4,261,182 A 4/1981 Elliott
4,288,497 A 9/1981 Tanaka et al.
4,402,185 A 9/1983 Perchak
4,402,194 A 9/1983 Kuwako et al.
4,412,429 A 11/1983 Kohl
4,462,345 A 7/1984 Routery
4,483,153 A 11/1984 Wallace
4,487,024 A 12/1984 Fletcher et al.
4,550,575 A 11/1985 DeGaynor
4,562,991 A 1/1986 Wu
4,587,810 A 5/1986 Fletcher
4,627,946 A 12/1986 Crabtree
4,628,699 A 12/1986 Mawby et al.
4,669,271 A 6/1987 Noel
4,680,943 A 7/1987 Mawby et al.
4,685,304 A 8/1987 Essig
4,688,386 A 8/1987 Lane et al.
4,727,720 A * 3/1988 Wernicki ..... F25B 21/02 62/3.63
4,831,840 A * 5/1989 Fletcher ..... F25C 1/04 249/121
4,843,827 A 7/1989 Peppers
4,852,359 A 8/1989 Manzotti
4,856,463 A 8/1989 Johnston
4,910,974 A 3/1990 Hara
4,942,742 A 7/1990 Burruel
4,970,877 A 11/1990 Dimijian
4,971,737 A 11/1990 Infanti
5,025,756 A 6/1991 Nyc
D318,281 S 7/1991 McKinlay
5,044,600 A 9/1991 Shannon
5,129,237 A 7/1992 Day et al.
5,157,929 A 10/1992 Hotaling
5,177,980 A 1/1993 Kawamoto et al.
5,196,127 A 3/1993 Solell
5,253,487 A 10/1993 Oike
5,257,601 A 11/1993 Coffin
5,272,888 A 12/1993 Fisher et al.
5,372,492 A 12/1994 Yamauchi
5,378,521 A 1/1995 Ogawa et al.
5,400,605 A 3/1995 Jeong
5,408,844 A 4/1995 Stokes
5,425,243 A 6/1995 Sanuki et al.
5,483,929 A 1/1996 Kuhn et al.
5,586,439 A 12/1996 Schlosser et al.
5,617,728 A 4/1997 Kim et al.
5,632,936 A 5/1997 Su et al.
5,618,463 A 8/1997 Rindler et al.
5,675,975 A 10/1997 Lee
5,761,920 A 6/1998 Wilson et al.
5,768,900 A 6/1998 Lee
5,826,320 A 10/1998 Rathke et al.
5,884,487 A 3/1999 Davis et al.
5,884,490 A 3/1999 Whidden
D415,505 S 10/1999 Myers
5,970,725 A 10/1999 Lee
5,970,735 A 10/1999 Hobelsberger
6,058,720 A 5/2000 Ryu
6,062,036 A 5/2000 Hobelsberger
6,082,130 A 7/2000 Pastryk et al.
6,101,817 A 8/2000 Watt

(56) References Cited

U.S. PATENT DOCUMENTS 6,145,320 A 11/2000 Kim
6,148,620 A 11/2000 Kumagai et al.
6,148,621 A 11/2000 Byczynski et al.
6,161,390 A 12/2000 Kim
6,179,045 B1 1/2001 Lilleaas
6,209,849 B1 4/2001 Dickmeyer
6,282,909 B1 9/2001 Newman et al.
6,289,683 B1 9/2001 Daukas et al.
6,357,720 B1 3/2002 Shapiro et al.
6,425,259 B2 7/2002 Nelson et al.
6,427,463 B1 8/2002 James
6,438,988 B1 8/2002 Paskey
6,467,146 B1 10/2002 Herman
6,481,235 B2 11/2002 Kwon
6,488,463 B1 12/2002 Harris
6,647,739 B1 11/2003 Kim et al.
6,688,130 B1 2/2004 Kim
6,688,131 B1 2/2004 Kim et al.
6,735,959 B1 5/2004 Najewicz
6,742,351 B2 6/2004 Kim et al.
6,763,787 B2 7/2004 Hallenstvedt et al.
6,782,706 B2 8/2004 Holmes et al.
D496,374 S 9/2004 Zimmerman
6,817,200 B2 11/2004 Willamor et al.
6,820,433 B2 11/2004 Hwang
6,823,689 B2 11/2004 Kim et al.
6,857,277 B2 2/2005 Somura
6,935,124 B2 8/2005 Takahashi et al.
6,951,113 B1 10/2005 Adamski
D513,019 S 12/2005 Lion et al.
7,010,934 B2 3/2006 Choi et al.
7,010,937 B2 3/2006 Wilkinson et al.
7,013,654 B2 3/2006 Tremblay et al.
7,051,541 B2 5/2006 Chung et al.
7,059,140 B2 6/2006 Zevlakis
7,062,925 B2 6/2006 Tsuchikawa et al.
7,062,936 B2 6/2006 Rand et al.
7,082,782 B2 8/2006 Schlosser et al.
7,093,456 B2 * 8/2006 Shoukyuu ..... F25C 1/10 241/DIG. 17
7,131,280 B2 11/2006 Voglewede et al.
7,185,508 B2 3/2007 Voglewede et al.
7,188,479 B2 3/2007 Anselmino et al.
7,201,014 B2 4/2007 Hornung
7,204,092 B2 4/2007 Castrellón et al.
7,210,298 B2 5/2007 Lin
7,216,490 B2 5/2007 Joshi
7,216,491 B2 5/2007 Cole et al.
7,234,423 B2 6/2007 Lindsay
7,266,973 B2 9/2007 Anderson et al.
7,297,516 B2 11/2007 Chapman et al.
7,318,323 B2 1/2008 Tatsui et al.
7,386,993 B2 6/2008 Castrellón et al.
7,415,833 B2 8/2008 Leaver et al.
7,448,863 B2 11/2008 Yang
7,464,565 B2 12/2008 Fu
7,469,553 B2 12/2008 Wu et al.
7,487,645 B2 2/2009 Sasaki et al.
7,568,359 B2 8/2009 Wetekamp et al.
7,587,905 B2 9/2009 Kopf
7,614,244 B2 11/2009 Venkatakrishnan et al.
7,669,435 B2 3/2010 Joshi
7,681,406 B2 3/2010 Cushman et al.
7,703,292 B2 4/2010 Cook et al.
7,707,847 B2 5/2010 Davis et al.
7,744,173 B2 6/2010 Maglinger et al.
7,752,859 B2 7/2010 Lee et al.
7,762,092 B2 7/2010 Tikhonov et al.
7,770,985 B2 8/2010 Davis et al.
7,802,457 B2 9/2010 Golovashchenko et al.
7,832,227 B2 11/2010 Wu et al.
7,866,167 B2 1/2011 Kopf
7,870,755 B2 1/2011 Hsu et al.
7,918,105 B2 4/2011 Kim
7,963,120 B2 6/2011 An et al.
8,015,849 B2 9/2011 Jones et al.
8,037,697 B2 10/2011 LeClear et al.
8,074,464 B2 12/2011 Venkatakrishnan et al.
8,099,989 B2 1/2012 Bradley et al.
8,104,304 B2 1/2012 Kang et al.
8,117,863 B2 2/2012 Van Meter et al.
8,171,744 B2 5/2012 Watson et al.
8,196,427 B2 6/2012 Bae et al.
8,281,613 B2 10/2012 An et al.
8,322,148 B2 12/2012 Kim et al.
8,336,327 B2 12/2012 Cole et al.
8,371,133 B2 2/2013 Kim et al.
8,371,136 B2 2/2013 Venkatakrishnan et al.
8,371,139 B2 * 2/2013 Kim ..... F25C 1/04 62/347
8,375,739 B2 2/2013 Kim et al.
8,375,919 B2 2/2013 Cook et al.
8,408,023 B2 4/2013 Shin et al.
8,413,619 B2 4/2013 Cleeves
8,424,334 B2 4/2013 Kang et al.
8,429,926 B2 4/2013 Shaha et al.
8,438,869 B2 5/2013 Kim et al.
8,474,279 B2 7/2013 Besore et al.
8,516,835 B2 8/2013 Holter
8,516,846 B2 8/2013 Lee et al.
8,555,658 B2 10/2013 Kim et al.
8,616,018 B2 12/2013 Jeong et al.
8,646,283 B2 2/2014 Kuratani et al.
8,677,774 B2 3/2014 Yamaguchi et al.
8,677,776 B2 3/2014 Kim et al.
8,707,726 B2 4/2014 Lim et al.
8,746,204 B2 6/2014 Hofbauer
8,756,952 B2 6/2014 Adamski et al.
8,769,981 B2 7/2014 Hong et al.
8,820,108 B2 9/2014 Oh et al.
8,893,523 B2 11/2014 Talegaonkar et al.
8,925,335 B2 1/2015 Gooden et al.
8,943,852 B2 2/2015 Lee et al.
9,010,145 B2 4/2015 Lim et al.
9,021,828 B2 5/2015 Vitan et al.
9,127,873 B2 9/2015 Tarr et al.
9,140,472 B2 9/2015 Shin et al.
9,175,896 B2 11/2015 Choi
9,200,828 B2 * 12/2015 Mitchell ..... F25D 17/065
9,217,595 B2 12/2015 Kim et al.
9,217,596 B2 12/2015 Hall
9,228,769 B2 1/2016 Kim et al.
9,476,631 B2 10/2016 Park et al.
9,829,235 B2 11/2017 Visin
9,879,896 B2 1/2018 Koo
10,174,982 B2 * 1/2019 Boarman ..... F25C 1/18
2002/0014087 A1 2/2002 Kwon
2003/0111028 A1 6/2003 Hallenstvedt
2004/0099004 A1 5/2004 Somura
2004/0144100 A1 7/2004 Hwang
2004/0206250 A1 10/2004 Kondou et al.
2004/0237566 A1 12/2004 Hwang
2004/0261427 A1 12/2004 Tsuchikawa et al.
2005/0067406 A1 3/2005 Rajarajan et al.
2005/0126185 A1 6/2005 Joshi
2005/0126202 A1 6/2005 Shoukyuu et al.
2005/0151050 A1 7/2005 Godfrey
2005/0160741 A1 7/2005 Park
2005/0160757 A1 7/2005 Choi et al.
2006/0016209 A1 1/2006 Cole et al.
2006/0032262 A1 2/2006 Seo et al.
2006/0053805 A1 3/2006 Flinner et al.
2006/0086107 A1 4/2006 Voglewede et al.
2006/0086134 A1 4/2006 Voglewede et al.
2006/0150645 A1 7/2006 Leaver
2006/0168983 A1 8/2006 Tatsui et al.
2006/0207282 A1 9/2006 Visin et al.
2006/0225457 A1 10/2006 Hallin
2006/0233925 A1 10/2006 Kawamura
2006/0242971 A1 11/2006 Cole et al.
2006/0288726 A1 12/2006 Mori et al.
2007/0028866 A1 2/2007 Lindsay
2007/0107447 A1 5/2007 Langlotz
2007/0119202 A1 5/2007 Kadowaki et al.

(56) References Cited

U.S. PATENT DOCUMENTS

| | | | |
|---|---|---|---|
| 2007/0130983 | A1 | 6/2007 | Broadbent et al. |
| 2007/0137241 | A1 | 6/2007 | Lee et al. |
| 2007/0193278 | A1 | 8/2007 | Polacek et al. |
| 2007/0227162 | A1 | 10/2007 | Wang |
| 2007/0227164 | A1 | 10/2007 | Ito et al. |
| 2007/0262230 | A1 | 11/2007 | McDermott |
| 2008/0034780 | A1 | 2/2008 | Lim et al. |
| 2008/0104991 | A1 | 5/2008 | Hoehne et al. |
| 2008/0145631 | A1 | 6/2008 | Bhate et al. |
| 2008/0236187 | A1 | 10/2008 | Kim |
| 2008/0264082 | A1 | 10/2008 | Tikhonov et al. |
| 2008/0289355 | A1 | 11/2008 | Kang et al. |
| 2009/0049858 | A1 | 2/2009 | Lee et al. |
| 2009/0120306 | A1 | 5/2009 | DeCarlo et al. |
| 2009/0165492 | A1 | 7/2009 | Wilson et al. |
| 2009/0173089 | A1 | 7/2009 | LeClear et al. |
| 2009/0178428 | A1 | 7/2009 | Cho et al. |
| 2009/0178430 | A1 | 7/2009 | Jendrusch et al. |
| 2009/0187280 | A1 | 7/2009 | Hsu et al. |
| 2009/0199569 | A1 | 8/2009 | Petrenko |
| 2009/0211266 | A1 | 8/2009 | Kim et al. |
| 2009/0211271 | A1 | 8/2009 | Kim et al. |
| 2009/0223230 | A1 | 9/2009 | Kim et al. |
| 2009/0235674 | A1 | 9/2009 | Kern et al. |
| 2009/0272259 | A1 | 11/2009 | Cook et al. |
| 2009/0308085 | A1 | 12/2009 | DeVos |
| 2010/0011827 | A1 | 1/2010 | Stoeger et al. |
| 2010/0018226 | A1 | 1/2010 | Kim et al. |
| 2010/0031675 | A1 | 2/2010 | Kim et al. |
| 2010/0043455 | A1 | 2/2010 | Kuehl et al. |
| 2010/0050663 | A1 | 3/2010 | Venkatakrishnan et al. |
| 2010/0050680 | A1 | 3/2010 | Venkatakrishnan et al. |
| 2010/0055223 | A1 | 3/2010 | Kondou et al. |
| 2010/0095692 | A1 | 4/2010 | Jendrusch et al. |
| 2010/0101254 | A1 | 4/2010 | Besore et al. |
| 2010/0126185 | A1 | 5/2010 | Cho et al. |
| 2010/0139295 | A1 | 6/2010 | Zuccolo et al. |
| 2010/0163707 | A1 | 7/2010 | Kim |
| 2010/0180608 | A1 | 7/2010 | Shaha et al. |
| 2010/0197849 | A1 | 8/2010 | Momose et al. |
| 2010/0218518 | A1 | 9/2010 | Ducharme et al. |
| 2010/0218540 | A1 | 9/2010 | McCollough et al. |
| 2010/0218542 | A1 | 9/2010 | McCollough et al. |
| 2010/0251730 | A1 | 10/2010 | Whillock, Sr. |
| 2010/0257888 | A1 | 10/2010 | Kang et al. |
| 2010/0293969 | A1 | 11/2010 | Braithwaite et al. |
| 2010/0313594 | A1 | 12/2010 | Lee et al. |
| 2010/0319367 | A1 | 12/2010 | Kim et al. |
| 2010/0326093 | A1 | 12/2010 | Watson et al. |
| 2011/0005263 | A1 | 1/2011 | Yamaguchi et al. |
| 2011/0023502 | A1 | 2/2011 | Ito et al. |
| 2011/0062308 | A1 | 3/2011 | Hammond et al. |
| 2011/0146312 | A1 | 6/2011 | Hong et al. |
| 2011/0192175 | A1 | 8/2011 | Kuratani et al. |
| 2011/0214447 | A1 | 9/2011 | Bortoletto et al. |
| 2011/0239686 | A1 | 10/2011 | Zhang et al. |
| 2011/0265498 | A1 | 11/2011 | Hall |
| 2012/0007264 | A1 | 1/2012 | Kondou et al. |
| 2012/0011868 | A1 | 1/2012 | Kim et al. |
| 2012/0023996 | A1* | 2/2012 | Herrera ..... F25C 1/04 62/340 |
| 2012/0047918 | A1 | 3/2012 | Herrera et al. |
| 2012/0073538 | A1 | 3/2012 | Hofbauer |
| 2012/0085302 | A1 | 4/2012 | Cleeves |
| 2012/0174613 | A1 | 7/2012 | Park et al. |
| 2012/0240613 | A1 | 9/2012 | Saito et al. |
| 2012/0291473 | A1 | 11/2012 | Krause et al. |
| 2015/0330678 | A1 | 11/2015 | Hu |
| 2016/0370078 | A1 | 12/2016 | Koo |
| 2017/0051966 | A1 | 2/2017 | Powell |
| 2017/0074527 | A1 | 3/2017 | Visin |
| 2017/0191722 | A1 | 7/2017 | Bertolini et al. |
| 2017/0241694 | A1 | 8/2017 | Ji et al. |
| 2017/0292748 | A1 | 10/2017 | Gullett |
| 2017/0307281 | A1 | 10/2017 | Morgan et al. |
| 2017/0314841 | A1 | 11/2017 | Koo et al. |
| 2017/0343275 | A1 | 11/2017 | Kim |
| 2018/0017306 | A1 | 1/2018 | Miller |
| 2018/0017309 | A1 | 1/2018 | Miller et al. |

FOREIGN PATENT DOCUMENTS

| | | | |
|---|---|---|---|
| CN | 102353193 | A | 9/2011 |
| DE | 202006012499 | U1 | 10/2006 |
| DE | 102008042910 | A1 | 4/2010 |
| DE | 102009046030 | | 4/2011 |
| EP | 1653171 | | 5/2006 |
| EP | 1710520 | A2 | 11/2006 |
| EP | 1821051 | A1 | 8/2007 |
| EP | 2078907 | A2 | 7/2009 |
| EP | 2375200 | | 10/2011 |
| EP | 2444761 | A2 | 4/2012 |
| EP | 2660541 | | 11/2013 |
| EP | 2743606 | A2 | 6/2014 |
| EP | 2743608 | A2 | 6/2014 |
| FR | 2771159 | A1 | 5/1999 |
| GB | 657353 | A | 9/1951 |
| GB | 2139337 | A | 11/1984 |
| JP | S489460 | | 2/1973 |
| JP | S5278848 | | 6/1977 |
| JP | S60141239 | A | 7/1985 |
| JP | S6171877 | U | 5/1986 |
| JP | 6435375 | | 3/1989 |
| JP | H01196478 | A | 8/1989 |
| JP | H01210778 | A | 8/1989 |
| JP | H01310277 | A | 12/1989 |
| JP | H024185 | A | 1/1990 |
| JP | H0231649 | A | 2/1990 |
| JP | H02143070 | A | 6/1990 |
| JP | H03158670 | A | 7/1991 |
| JP | H03158673 | A | 7/1991 |
| JP | H0415069 | A | 1/1992 |
| JP | H04161774 | A | 6/1992 |
| JP | H4260764 | A | 9/1992 |
| JP | H051870 | A | 1/1993 |
| JP | H05248746 | A | 9/1993 |
| JP | H05332562 | A | 12/1993 |
| JP | H063005 | A | 1/1994 |
| JP | H0611219 | A | 1/1994 |
| JP | H06323704 | A | 11/1994 |
| JP | H10227547 | A | 8/1998 |
| JP | H10253212 | A | 9/1998 |
| JP | H11223434 | A | 8/1999 |
| JP | 2000039240 | A | 2/2000 |
| JP | 2000346506 | A | 12/2000 |
| JP | 2001041620 | A | 2/2001 |
| JP | 2001041624 | A | 2/2001 |
| JP | 2001221545 | A | 8/2001 |
| JP | 2001355946 | | 12/2001 |
| JP | 2001355946 | A * | 12/2001 |
| JP | 2002139268 | A | 5/2002 |
| JP | 2002295934 | A | 10/2002 |
| JP | 2002350019 | A | 12/2002 |
| JP | 2002350019 | A * | 12/2002 |
| JP | 2003042612 | A | 2/2003 |
| JP | 2003042621 | A | 2/2003 |
| JP | 2003172564 | A | 6/2003 |
| JP | 2003232587 | A | 8/2003 |
| JP | 2003269830 | A | 9/2003 |
| JP | 2003279214 | A | 10/2003 |
| JP | 2003336947 | A | 11/2003 |
| JP | 2004053036 | A | 2/2004 |
| JP | 2004278894 | A * | 10/2004 |
| JP | 2004278894 | A | 10/2004 |
| JP | 2004278990 | A | 10/2004 |
| JP | 2005164145 | A | 6/2005 |
| JP | 2005180825 | A | 7/2005 |
| JP | 2005195315 | A | 7/2005 |
| JP | 2006022980 | A | 1/2006 |
| JP | 2006071247 | A | 3/2006 |
| JP | 2006323704 | A | 11/2006 |
| JP | 2007232336 | A | 9/2007 |
| JP | 4333202 | B2 | 9/2009 |
| KR | 20010109256 | A | 12/2001 |

(56) References Cited

FOREIGN PATENT DOCUMENTS

| | | | |
|---|---|---|---|
| KR | 20060013721 | A | 2/2006 |
| KR | 20060126156 | A | 12/2006 |
| KR | 100845860 | B1 | 7/2008 |
| KR | 20090132283 | A | 12/2009 |
| KR | 20100123089 | A | 11/2010 |
| KR | 20110037609 | A | 4/2011 |
| RU | 2365832 | | 8/2009 |
| SU | 1747821 | A1 | 7/1992 |
| TW | 424878 | U | 3/2001 |
| WO | 8808946 | A1 | 11/1988 |
| WO | 2008052736 | A1 | 5/2008 |
| WO | 2008056957 | A2 | 5/2008 |
| WO | 2008061179 | A2 | 5/2008 |
| WO | 2008143451 | A1 | 11/2008 |
| WO | 2012023717 | A2 | 2/2012 |
| WO | 2012025369 | | 3/2012 |
| WO | 2017039334 | A2 | 3/2017 |

OTHER PUBLICATIONS

"Nickel Alloys for Electronics," A Nickel Development Institute Reference Book, 1988, 131 pages, Series N 11 002, NiDI Nickel Development Institute.

Daehn, "High-Velocity Metal Forming," ASM Handbook, 2006, pp. 405-418, vol. 148, ASM International.

Daehn, et al., "Hyperplacstic Forming: Process Potential and Factors Affecting Formability," MRS Proceedings, 1999, at p. 147, vol. 601.

Jimbert et al., "Flanging and Hemming of Auto Body Panels using the Electro Magnetic Forming technology," 3rd International Conference on High Speed Forming, 2008, pp. 163-172.

Shang et al., "Electromagnetically assisted sheet metal stamping," Journal of Materials Processing Technology, 2010, pp. 868-874, 211.

Merriam-Webster definition of oscillate, http://www.Merriam-Webster.com/dictionary/oscillate, pp. 1-4, accessed from internet Aug. 6, 2015.

* cited by examiner

TWIST HARVEST ICE GEOMETRY

CROSS-REFERENCE TO RELATED APPLICATIONS

The present application is a continuation of and claims priority to U.S. patent application Ser. No. 15/357,633 (now U.S. Pat. No. 9,816,744), filed Nov. 21, 2016, entitled, "TWIST HARVEST ICE GEOMETRY," which is a continuation of U.S. patent application Ser. No. 13/713,228, filed Dec. 13, 2012, entitled "TWIST HARVEST ICE GEOMETRY," now U.S. Pat. No. 9,500,398, the entire disclosures of which are hereby incorporated herein by reference.

The present application is also related to, and hereby incorporates by reference the entire disclosures of, the following applications for United States Patents: U.S. Pat. No. 9,410,723, entitled "ICE MAKER WITH ROCKING COLD PLATE," issued on Aug. 9, 2016; U.S. Pat. No. 9,759,472, entitled "CLEAR ICE MAKER WITH WARM AIR FLOW," issued on Sep. 12, 2017; U.S. Pat. No. 9,599,388, entitled "CLEAR ICE MAKER WITH VARIED THERMAL CONDUCTIVITY," issued on Mar. 21, 2017; U.S. Pat. No. 9,518,773, entitled "CLEAR ICE MAKER," issued on Dec. 13, 2016; U.S. Pat. No. 9,310,115, entitled "LAYERING OF LOW THERMAL CONDUCTIVE MATERIAL ON METAL TRAY," issued on Apr. 12, 2016; U.S. Pat. No. 9,557,087, entitled "CLEAR ICE MAKER," issued on Jan. 31, 2017; U.S. Pat. No. 9,303,903, entitled "COOLING SYSTEM FOR ICE MAKER," issued on Apr. 5, 2016; U.S. Pat. No. 9,476,629, entitled "CLEAR ICE MAKER AND METHOD FOR FORMING CLEAR ICE," issued on Oct. 25, 2016; U.S. Pat. No. 9,273,891, entitled "ROTATIONAL ICE MAKER," issued on Mar. 1, 2016; and U.S. patent application Ser. No. 13/713,253, entitled "CLEAR ICE MAKER AND METHOD FOR FORMING CLEAR ICE," filed on Dec. 13, 2012.

FIELD OF THE INVENTION

The present invention generally relates to an ice maker for making substantially clear ice pieces, and methods for the production of clear ice pieces. More specifically, the present invention generally relates to an ice maker and methods which are capable of making substantially clear ice without the use of a drain.

BACKGROUND OF THE INVENTION

During the ice making process when water is frozen to form ice cubes, trapped air tends to make the resulting ice cubes cloudy in appearance. The trapped air results in an ice cube which, when used in drinks, can provide an undesirable taste and appearance which distracts from the enjoyment of a beverage. Clear ice requires processing techniques and structure which can be costly to include in consumer refrigerators and other appliances. There have been several attempts to manufacture clear ice by agitating the ice cube trays during the freezing process to allow entrapped gases in the water to escape.

BRIEF SUMMARY OF THE INVENTION

One aspect of the present invention comprises an ice making apparatus for an appliance that includes an ice making tray having a metallic ice forming plate with a top surface and a bottom surface, and at least one perimeter sidewall and one dividing wall extending upwardly from the top surface. The at least one perimeter sidewall and the at least one dividing wall and the top surface of the ice forming plate form an ice compartment having an upper surface and a lower surface, and a height therebetween. An ice body is formed in the at least one compartment. The at least one perimeter sidewall and the at least one dividing wall form a draft angle with the top surface of the ice forming plate of about 17° to about 25°.

Another aspect of the present invention includes a method of forming ice, including the steps of forming at least one ice body within at least one ice compartment defined by at least one perimeter sidewall, at least one dividing wall, and a top surface of an ice forming plate, and wherein the at least one perimeter sidewall and the at least one dividing wall form a draft angle with the top surface of the ice forming plate of from about 17° to about 25°. The at least one perimeter sidewall and at least one dividing wall together form a grid. The grid and ice forming plate are at least partially inverted via a first rotation. The grid is then separated from the ice forming plate and is rotated in a second rotation which is in the same direction as the first rotation. The grid is then twisted to separate sections of the ice body from the grid; and the at least one ice body is collected in a storage container, where it is stored until being dispensed to a user.

Another aspect of the present invention includes an ice making apparatus for an appliance that includes an ice making tray having a metallic ice forming plate with a top surface and a bottom surface, and at least one perimeter sidewall extending upwardly from the top surface. The at least one perimeter sidewall and the ice forming plate form a water basin. A grid with at least one dividing wall is also provided. The at least one perimeter sidewall and the at least one dividing wall and the top surface of the ice forming plate form at least one compartment having an upper surface and a lower surface, and a height therebetween. An ice body is formed in the at least one compartment. The at least one perimeter sidewall and the at least one dividing wall form a draft angle with the top surface of the ice forming plate, of about 17° to about 25°. The height of the at least one compartment is between about 9 mm to about 14 mm.

These and other features, advantages, and objects of the present invention will be further understood and appreciated by those skilled in the art by reference to the following specification, claims, and appended drawings.

DETAILED DESCRIPTION

Figure 2:
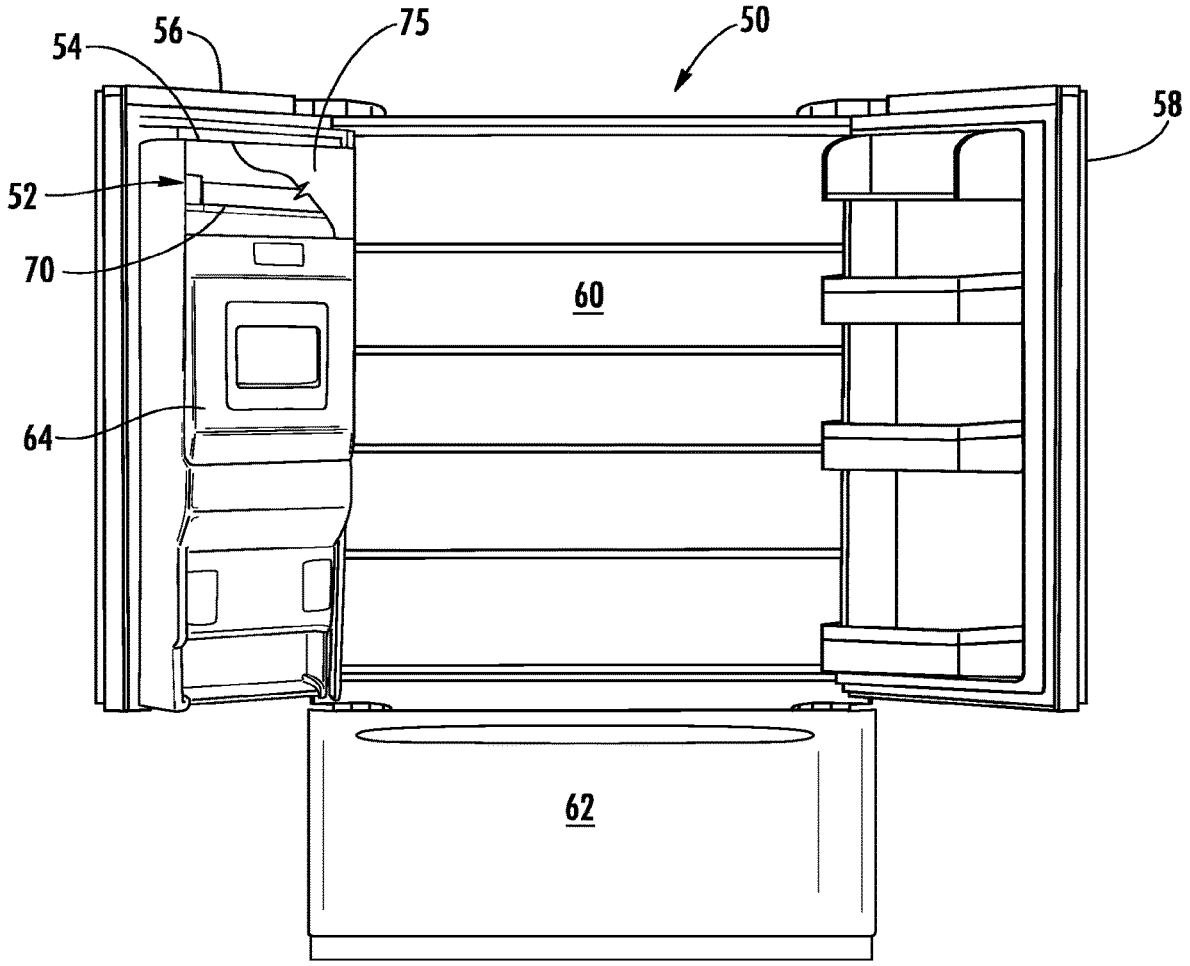
FIG. 2 is a front view of an appliance with open doors, having an ice maker of the present invention.

For purposes of description herein, the terms "upper," "lower," "right," "left," "rear," "front," "vertical," "horizontal," and derivates thereof shall relate to the ice maker assembly 52, 210 as oriented in FIG. 2 unless stated otherwise. However, it is to be understood that the ice maker assembly may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
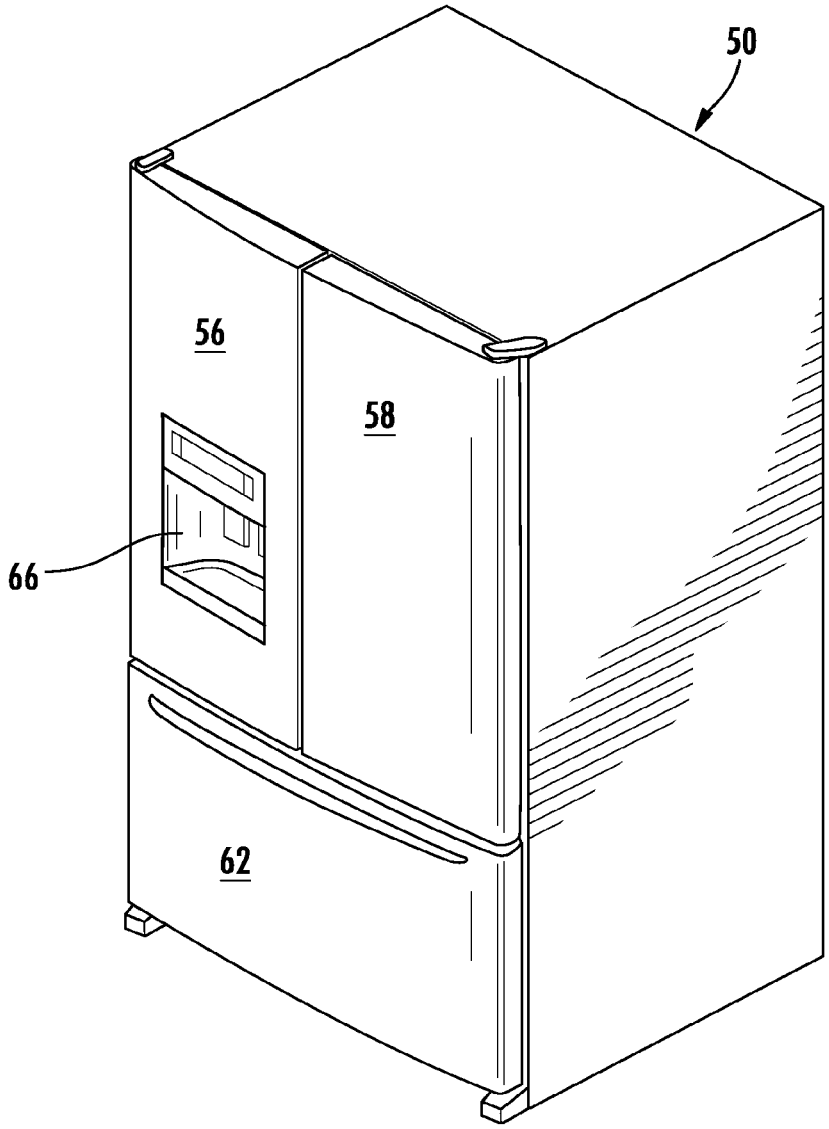
FIG. 1 is a top perspective view of an appliance having an ice maker of the present invention.

Referring initially to FIGS. 1-2, there is generally shown a refrigerator 50, which includes an ice maker 52 contained within an ice maker housing 54 inside the refrigerator 50. Refrigerator 50 includes a pair of doors 56, 58 to the refrigerator compartment 60 and a drawer 62 to a freezer compartment (not shown) at the lower end. The refrigerator 50 can be differently configured, such as with two doors, the freezer on top, and the refrigerator on the bottom or a side-by-side refrigerator/freezer. Further, the ice maker 52 may be housed within refrigerator compartment 60 or freezer compartment or within any door of the appliance as desired. The ice maker could also be positioned on an outside surface of the appliance, such as a top surface as well.

The ice maker housing 54 communicates with an ice cube storage container 64, which, in turn, communicates with an ice dispenser 66 such that ice 98 can be dispensed or otherwise removed from the appliance with the door 56 in the closed position. The dispenser 66 is typically user activated.

In one aspect, the ice maker 52 of the present invention employs varied thermal input to produce clear ice pieces 98 for dispensing. In another aspect the ice maker of the present invention employs a rocking motion to produce clear ice pieces 98 for dispensing. In another, the ice maker 52 uses materials of construction with varying conductivities to produce clear ice pieces for dispensing. In another aspect, the ice maker 52 of the present invention is a twist-harvest ice maker 52. Any one of the above aspects, or any combination thereof, as described herein may be used to promote the formation of clear ice. Moreover, any aspect of the elements of the present invention described herein may be used with other embodiments of the present invention described, unless clearly indicated otherwise.

Figure 3:
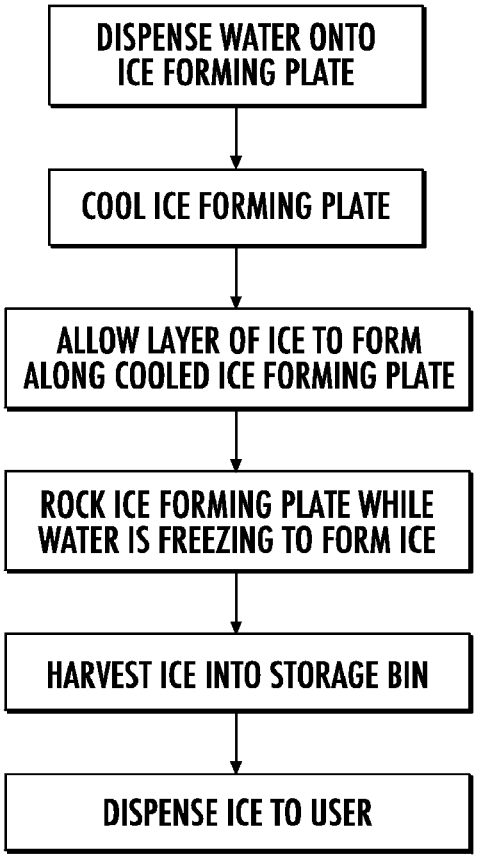
FIG. 3 is a flow chart illustrating one process for producing clear ice according to the invention.

In general, as shown in FIG. 3, the production of clear ice 98 includes, but may not be limited to, the steps of: dispensing water onto an ice forming plate 76, cooling the ice forming plate 76, allowing a layer of ice to form along the cooled ice forming plate 76, and rocking the ice forming plate 76 while the water is freezing. Once the clear ice 98 is formed, the ice 98 is harvested into a storage bin 64. From the storage bin 64, the clear ice 98 is available for dispensing to a user.

In certain embodiments, multiple steps may occur simultaneously. For example, the ice forming plate 76 may be cooled and rocked while the water is being dispensed onto the ice forming plate 76. However, in other embodiments, the ice forming plate 76 may be held stationary while water is dispensed, and rocked only after an initial layer of ice 98 has formed on the ice forming plate 76. Allowing an initial layer of ice to form prior to initiating a rocking movement prevents flash freezing of the ice or formation of a slurry, which improves ice clarity.

In one aspect of the invention, as shown in FIGS. 4-12, an ice maker 52 includes a twist harvest ice maker 52 which utilizes oscillation during the freezing cycle, variations in conduction of materials, a cold air 182 flow to remove heat from the heat sink 104 and cool the underside of the ice forming plate 76 and a warm air 174 flow to produce clear ice pieces 98. In this embodiment, one driving motor 112, 114 is typically present on each end of the ice tray 70.

Figure 4:
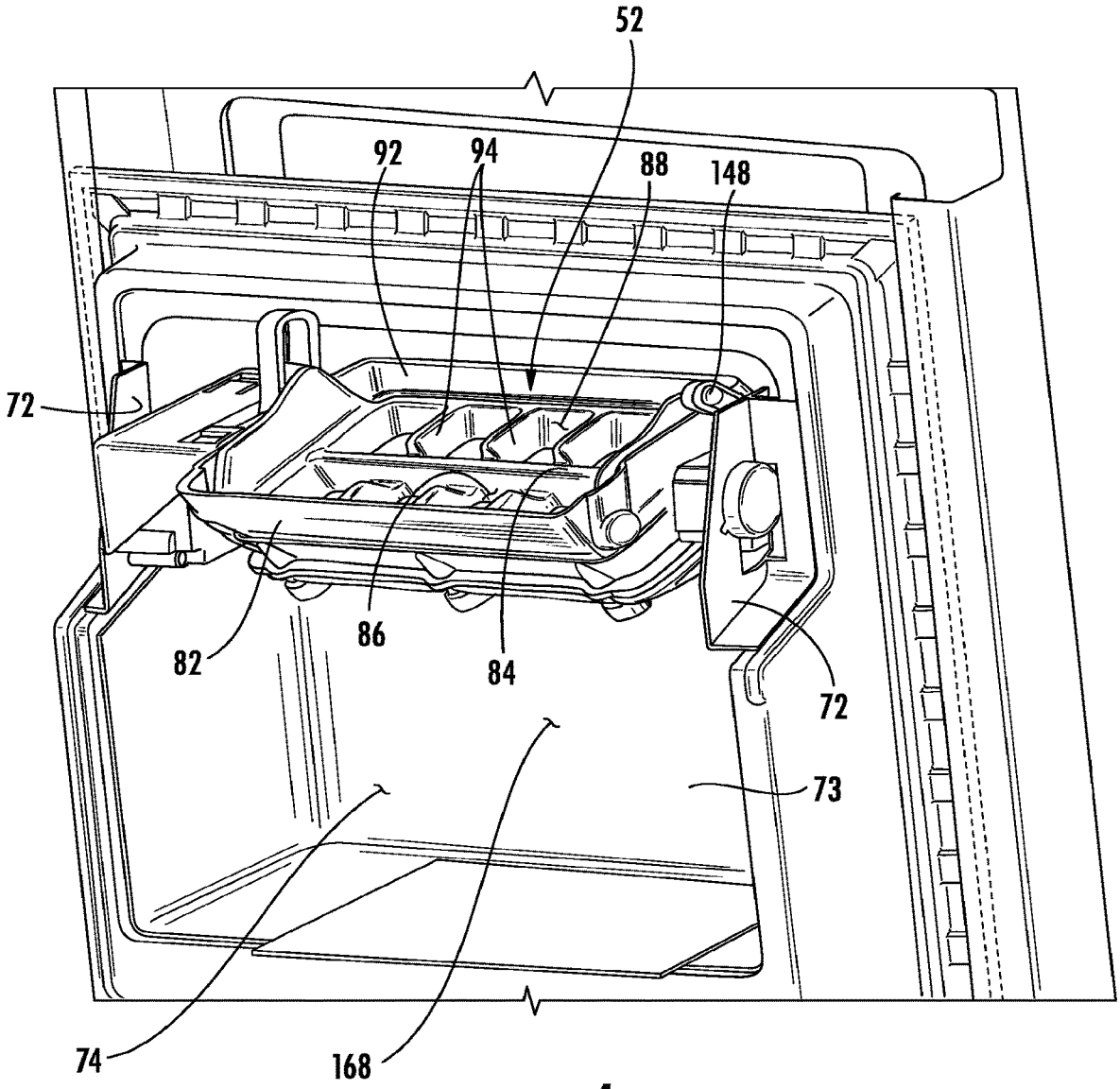
FIG. 4 is a top perspective view of a door of an appliance having a first embodiment of an ice maker according to the present invention.
Figure 5:
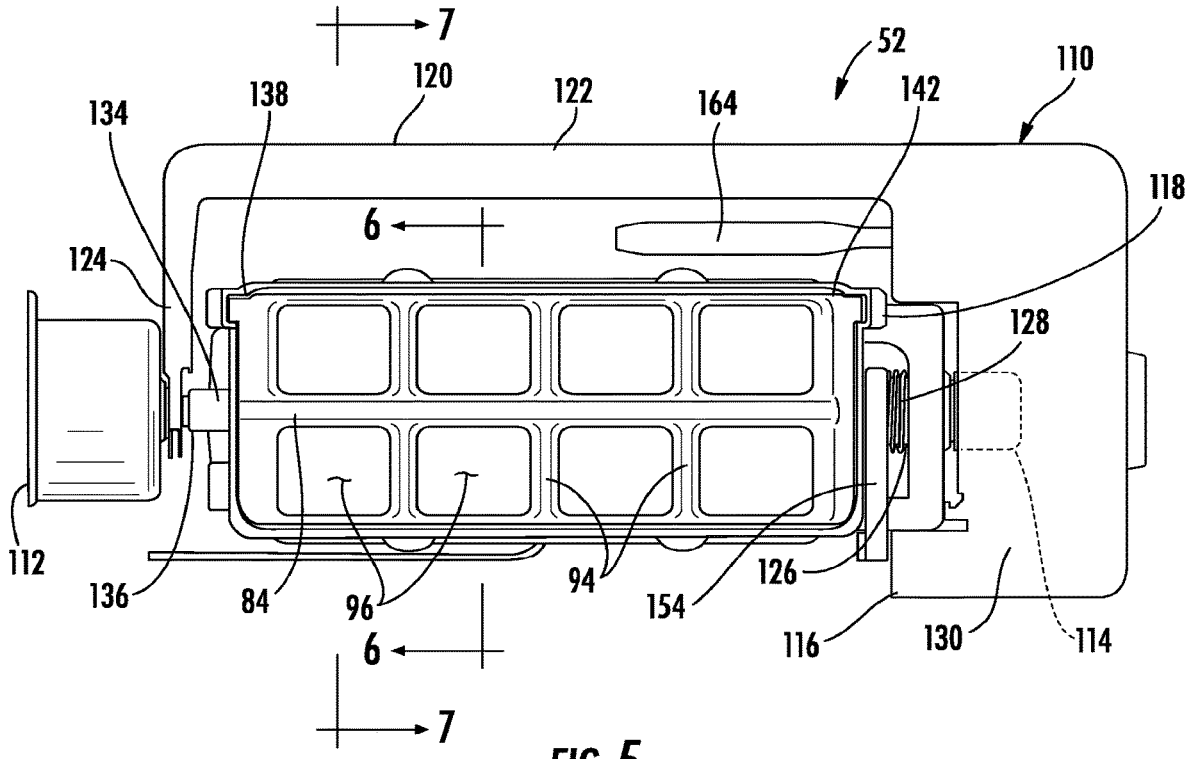
FIG. 5 is a top view of an ice maker according to the present invention.
Figure 6:
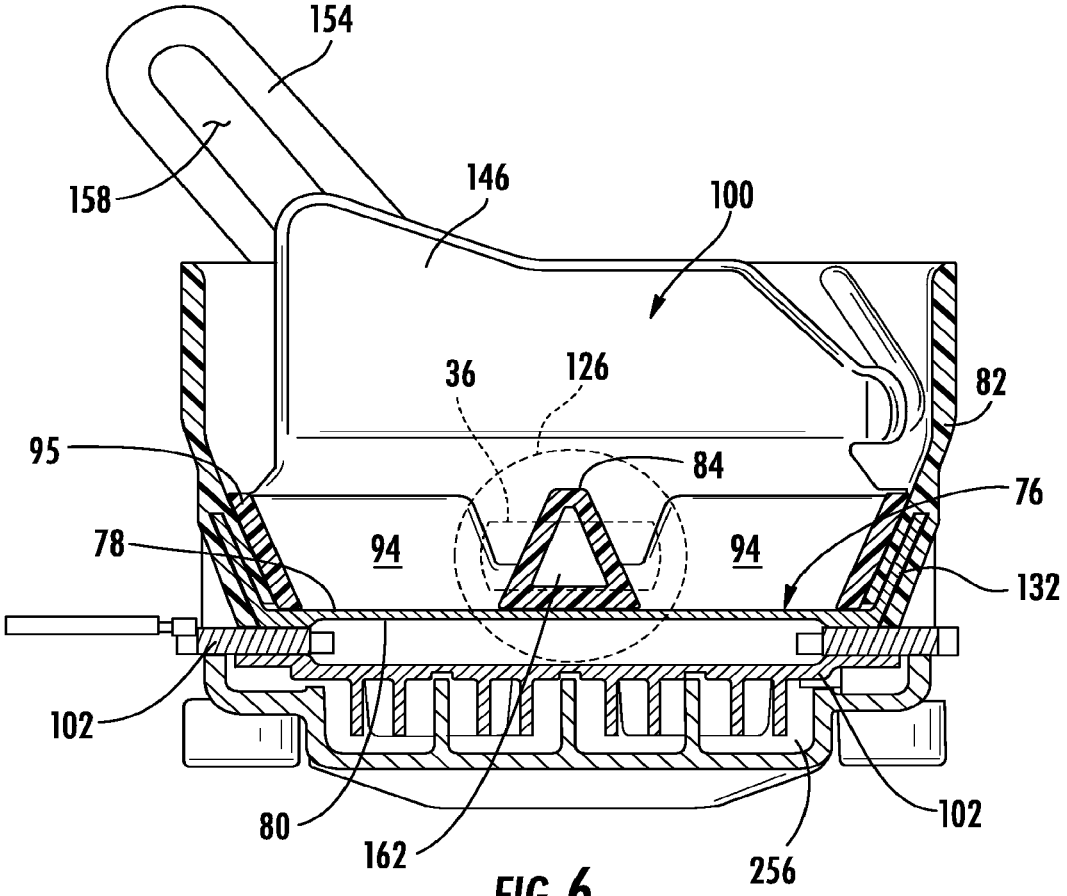
FIG. 6 is a cross sectional view of an ice maker according to the present invention taken along the line 6-6 in FIG. 5.

In the embodiment depicted in FIGS. 4-12, an ice tray 70 is horizontally suspended across and pivotally coupled to stationary support members 72 within an ice maker housing 54. The housing 54 may be integrally formed with a door liner 73, and include the door liner 73 with a cavity 74 therein, and a cover 75 pivotally coupled with a periphery of the cavity 74 to enclose the cavity 74. The ice tray 70, as depicted in FIG. 6, includes an ice forming plate 76, with a top surface 78 and a bottom surface 80. Typically, a containment wall 82 surrounds the top surface 78 of the ice forming plate 76 and extends upwards around the periphery thereof. The containment wall 82 is configured to retain water on the top surface 78 of the ice forming plate 76. A median wall 84 extends orthogonally from the top surface 78 of the ice forming plate 76 along a transverse axis thereof, dividing the ice tray 70 into at least two reservoirs 86, 88, with a first reservoir 86 defined between the median wall 84 and a first sidewall 90 of the containment wall 82 and a second reservoir 88 defined between the median wall 84 and a second sidewall 92 of the containment wall 82, which is generally opposing the first sidewall 90 of the containment wall 82. Further dividing walls 94 extend generally orthogonally from the top surface 78 of the ice forming plate 76 generally perpendicularly to the median wall 84. These dividing walls 94 further separate the ice tray 70 into an array of individual compartments 96 for the formation of clear ice pieces 98.

A grid 100 is provided, as shown in FIGS. 4-7F and 12A-12B which forms the median wall 84 the dividing walls 94, and an edge wall 95. As further described, the grid 100 is separable from the ice forming plate 76 and the containment wall 82, and is preferably resilient and flexible to facilitate harvesting of the clear ice pieces 98.

As shown in FIG. 6, a thermoelectric device 102 is physically affixed and thermally connected to the bottom surface 80 of the ice forming plate 76 to cool the ice forming plate 76, and thereby cool the water added to the top surface 78 of the ice forming plate 76. The thermoelectric device 102 is coupled to a heat sink 104, and transfers heat from the bottom surface 80 of the ice forming plate 76 to the heat sink 104 during formation of clear ice pieces 98. One example of such a device is a thermoelectric plate which can be coupled to a heat sink 104, such as a Peltier-type thermoelectric cooler.

As shown in FIGS. 5 and 7A-7F, in one aspect the ice tray 70 is supported by and pivotally coupled to a rocker frame 110, with an oscillating motor 112 operably connected to the rocker frame 110 and ice tray 70 at one end 138, and a harvest motor 114 operably connected to the ice tray 70 at a second end 142.

Figure 12A:
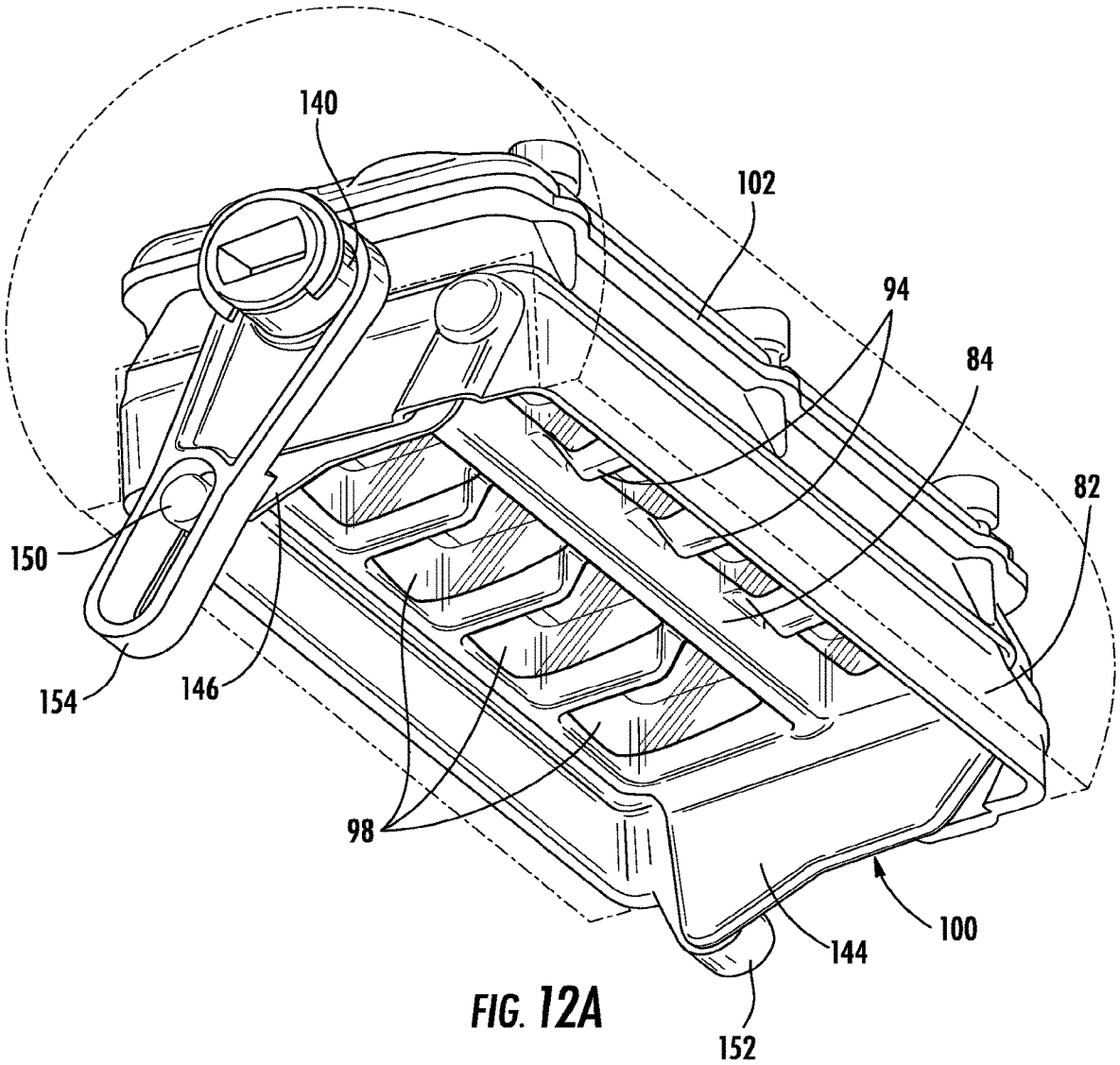
FIG. 12A is a bottom perspective view of an ice maker of the present invention in the inverted position and with the frame and motors removed for clarity.
Figure 12B:
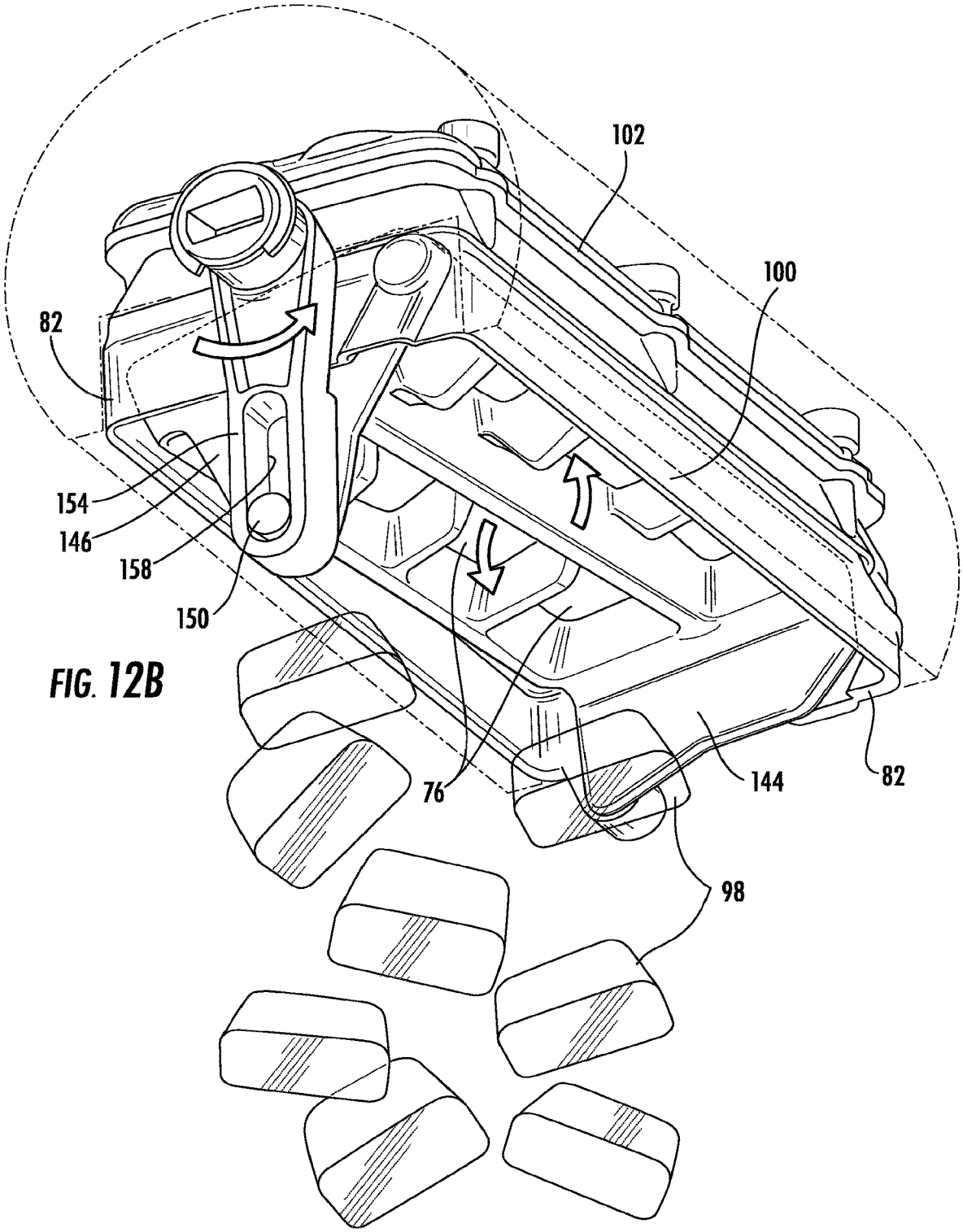
FIG. 12B is a bottom perspective view of the ice maker shown in FIG. 12A, in the twisted harvest position and with the frame and motors removed for clarity.

The rocker frame 110 is operably coupled to an oscillating motor 112, which rocks the frame 110 in a back and forth motion, as illustrated in FIGS. 7A-7F. As the rocker frame 110 is rocked, the ice tray 70 is rocked with it. However, during harvesting of the clear ice pieces 98, the rocker frame remains 110 stationary and the harvest motor 114 is actuated. The harvest motor 114 rotates the ice tray 70 approximately 120°, as shown in FIGS. 12A and 12B, until a stop 116, 118 between the rocker frame 110 and ice forming plate 76 prevents the ice forming plate 76 and containment wall 82 from further rotation. Subsequently, the harvest motor 114 continues to rotate the grid 100, twisting the grid 100 to release clear ice pieces 98, as illustrated in FIG. 12B.

Having briefly described the overall components and their orientation in the embodiment depicted in FIGS. 4-12B, and their respective motion, a more detailed description of the construction of the ice maker 52 is now presented.

The rocker frame 110 in the embodiment depicted in FIGS. 4-12B includes a generally open rectangular member 120 with a longitudinally extending leg 122, and a first arm 124 at the end 138 adjacent the oscillating motor 112 and coupled to a rotary shaft 126 of the oscillating motor 112 by a metal spring clip 128. The oscillating motor 112 is fixedly secured to a stationary support member 72 of the refrigerator 50. The frame 110 also includes a generally rectangular housing 130 at the end 142 opposite the oscillating motor 112 which encloses and mechanically secures the harvest motor 114 to the rocker frame 110. This can be accomplished by snap-fitting tabs and slots, threaded fasteners, or any other conventional manner, such that the rocker frame 110 securely holds the harvest motor 114 coupled to the ice tray 70 at one end 138, and the opposite end 142 of the ice tray 70 via the arm 124. The rocker frame 110 has sufficient strength to support the ice tray 70 and the clear ice pieces 98 formed therein, and is typically made of a polymeric material or blend of polymeric materials, such as ABS (acrylonitrile, butadiene, and styrene), though other materials with sufficient strength are also acceptable.

As shown in FIG. 5, the ice forming plate 76 is also generally rectangular. As further shown in the cross-sectional view depicted in FIG. 6, the ice forming plate 76 has upwardly extending edges 132 around its exterior, and the containment wall 82 is typically integrally formed over the upwardly extending edges 132 to form a water-tight assembly, with the upwardly extending edge 132 of the ice forming plate 76 embedded within the lower portion of the containment wall 82. The ice forming plate 76 is preferably a thermally conductive material, such as metal. As a non-limiting example, a zinc-alloy is corrosion resistant and suitably thermally conductive to be used in the ice forming plate 76. In certain embodiments, the ice forming plate 76 can be formed directly by the thermoelectric device 102, and in other embodiments the ice forming plate 76 is thermally linked with thermoelectric device 102. The containment walls 82 are preferably an insulative material, including, without limitation, plastic materials, such as polypropylene. The containment wall 82 is also preferably molded over the upstanding edges 132 of the ice forming plate 76, such as by injection molding, to form an integral part with the ice forming plate 76 and the containment wall 82. However, other methods of securing the containment wall 82, including, without limitation, mechanical engagement or an adhesive, may also be used. The containment wall 82 may diverge outwardly from the ice forming plate 76, and then extend in an upward direction which is substantially vertical.

The ice tray 70 includes an integral axle 134 which is coupled to a drive shaft 136 of the oscillating motor 112 for supporting a first end 138 of the ice tray 70. The ice tray 70 also includes a second pivot axle 140 at an opposing end 142 of the ice tray 70, which is rotatably coupled to the rocker frame 110.

The grid 100, which is removable from the ice forming plate 76 and containment wall 82, includes a first end 144 and a second end 146, opposite the first end 144. Where the containment wall 82 diverges from the ice forming plate 76 and then extends vertically upward, the grid 100 may have a height which corresponds to the portion of the containment wall 82 which diverges from the ice forming plate 76. As shown in FIG. 4, the wall 146 on the end of the grid 100 adjacent the harvest motor 114 is raised in a generally triangular configuration. A pivot axle 148 extends outwardly from the first end 144 of the grid 100, and a cam pin 150 extends outwardly from the second end 146 of the grid 100. The grid 100 is preferably made of a flexible material, such as a flexible polymeric material or a thermoplastic material or blends of materials. One non-limiting example of such a material is a polypropylene material.

The containment wall 82 includes a socket 152 at its upper edge for receiving the pivot axle 148 of the grid 100. An arm 154 is coupled to a drive shaft 126 of the harvest motor 114, and includes a slot 158 for receiving the cam pin 150 formed on the grid 100.

A torsion spring 128 typically surrounds the internal axle 134 of the containment wall 82, and extends between the arm 154 and the containment wall 82 to bias the containment wall 82 and ice forming plate 76 in a horizontal position, such that the cam pin 150 of the grid 100 is biased in a position of the slot 158 of the arm 154 toward the ice forming plate 76. In this position, the grid 100 mates with the top surface 78 of the ice forming plate 76 in a closely adjacent relationship to form individual compartments 96 that have the ice forming plate defining the bottom and the grid defining the sides of the individual ice forming compartments 96, as seen in FIG. 6.

The grid 100 includes an array of individual compartments 96, defined by the median wall 84, the edge walls 95 and the dividing walls 94. The compartments 96 are generally square in the embodiment depicted in FIGS. 4-12B, with inwardly and downwardly extending sides. As discussed above, the bottoms of the compartments 96 are defined by the ice forming plate 76. Having a grid 100 without a bottom facilitates in the harvest of ice pieces 98 from the grid 100, because the ice piece 98 has already been released from the ice forming plate 76 along its bottom when the ice piece 98 is harvested. In the shown embodiment, there are eight such compartments. However, the number of compartments 96 is a matter of design choice, and a greater or lesser number may be present within the scope of this disclosure. Further, although the depiction shown in FIG. 4 includes one median wall 84, with two rows of compartments 96, two or more median walls 84 could be provided.

As shown in FIG. 6, the edge walls 95 of the grid 100 as well as the dividing walls 94 and median wall 84 diverge outwardly in a triangular manner, to define tapered compartments 96 to facilitate the removal of ice pieces 98 therefrom. The triangular area 162 within the wall sections may be filled with a flexible material, such as a flexible silicone material or EDPM (ethylene propylene diene monomer M-class rubber), to provide structural rigidity to the grid 100 while at the same time allowing the grid 100 to flex during the harvesting step to discharge clear ice pieces 98 therefrom.

The ice maker 52 is positioned over an ice storage bin 64. Typically, an ice bin level detecting arm 164 extends over the top of the ice storage bin 64, such that when the ice storage bin 64 is full, the arm 164 is engaged and will turn off the ice maker 52 until such time as additional ice 98 is needed to fill the ice storage bin 64.

Figure 7A:
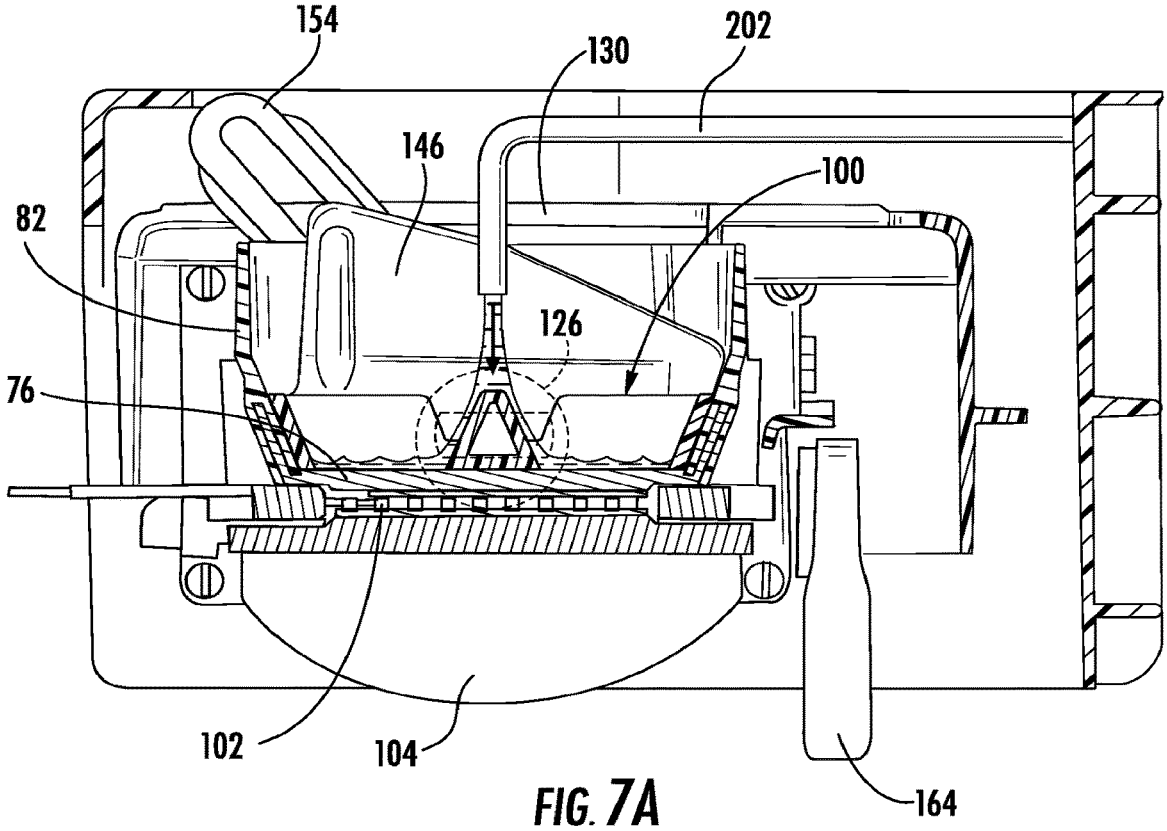
FIG. 7A is a cross sectional view of an ice maker according to the present invention, taken along the line 7-7 in FIG. 5, with water shown being added to an ice tray.
Figure 7B:
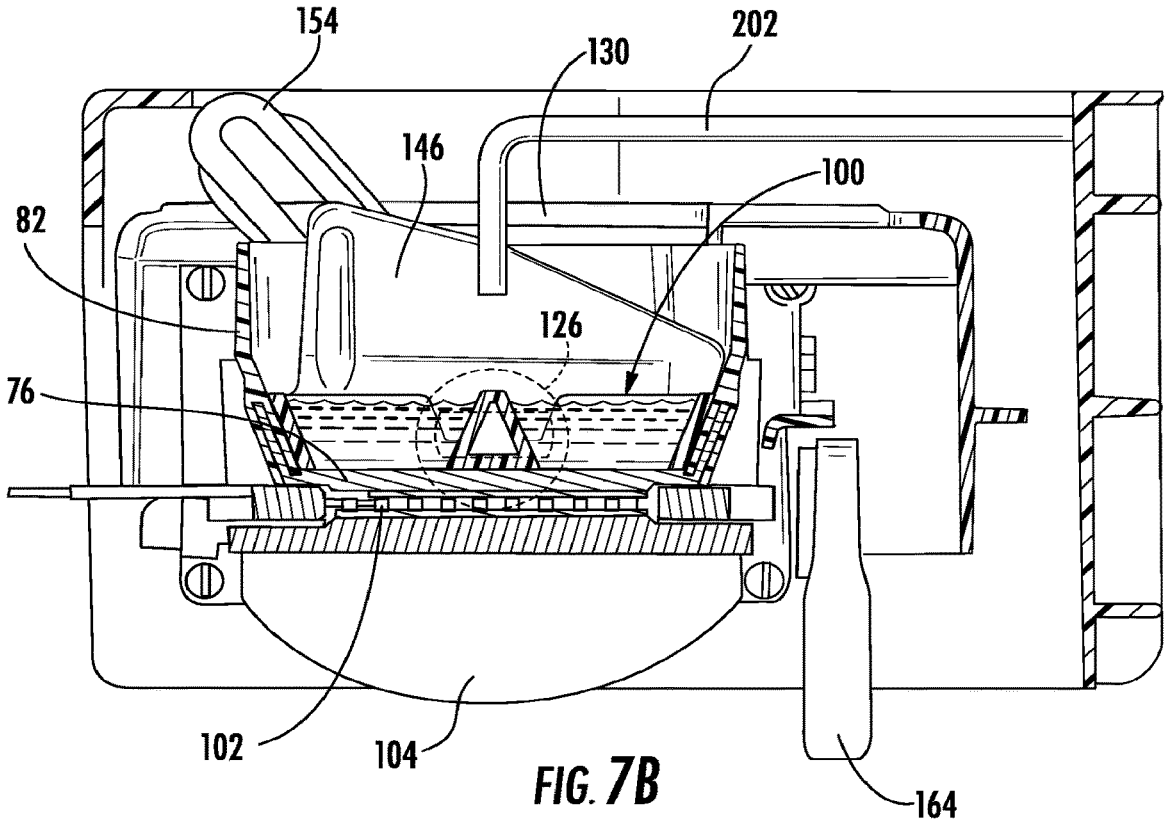
FIG. 7B is a cross sectional view the ice maker of FIG. 7A, with water added to the ice tray.
Figure 7C:
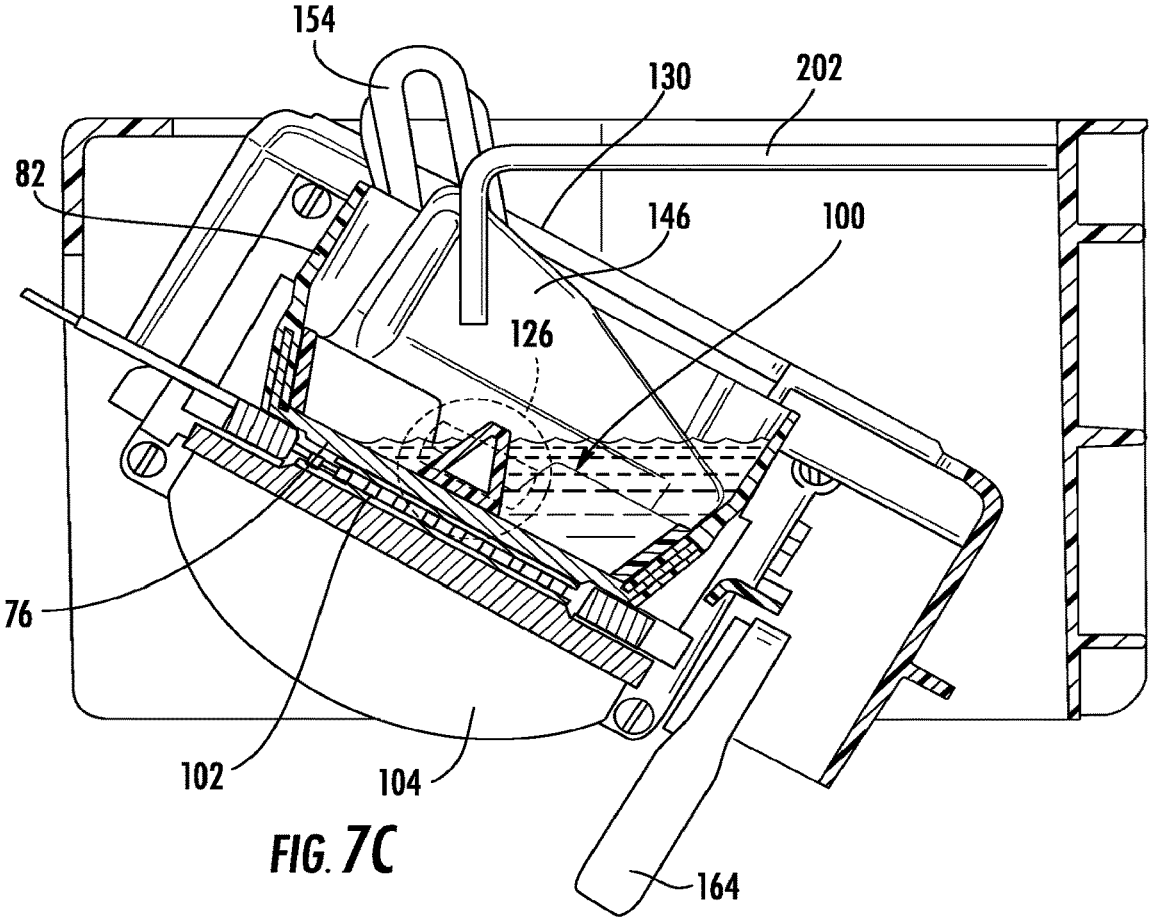
FIGS. 7C-7E are cross sectional views of the ice maker of FIG. 7A, showing the oscillation of the ice maker during a freezing cycle.
Figure 7D:
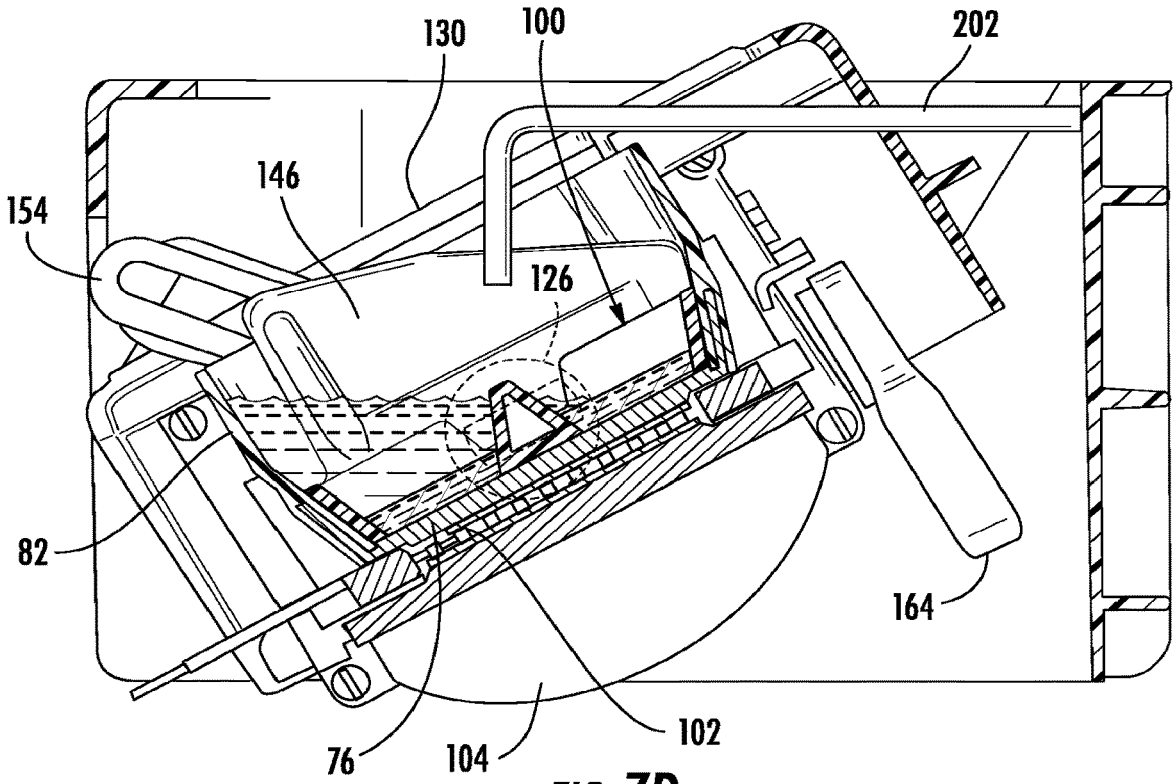
Figure 7E:
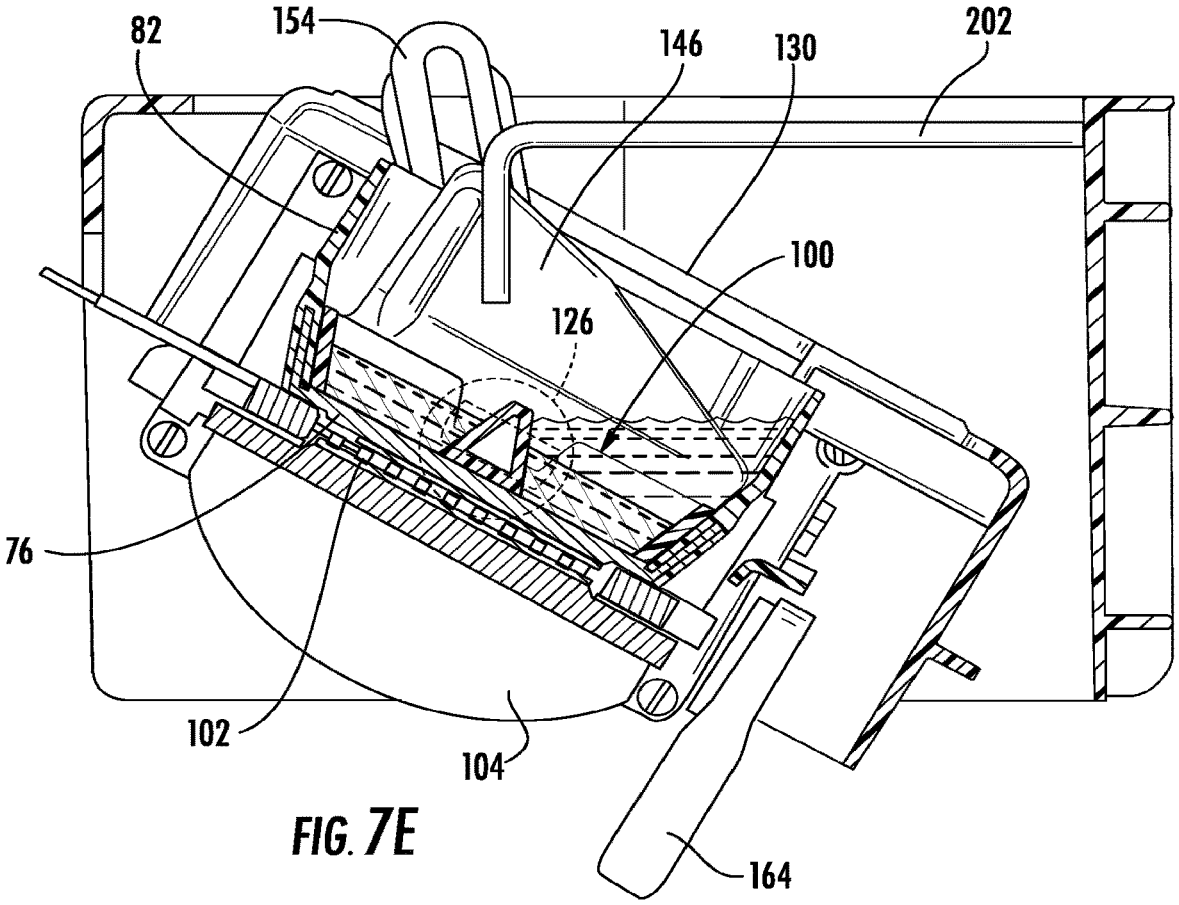
Figure 7F:
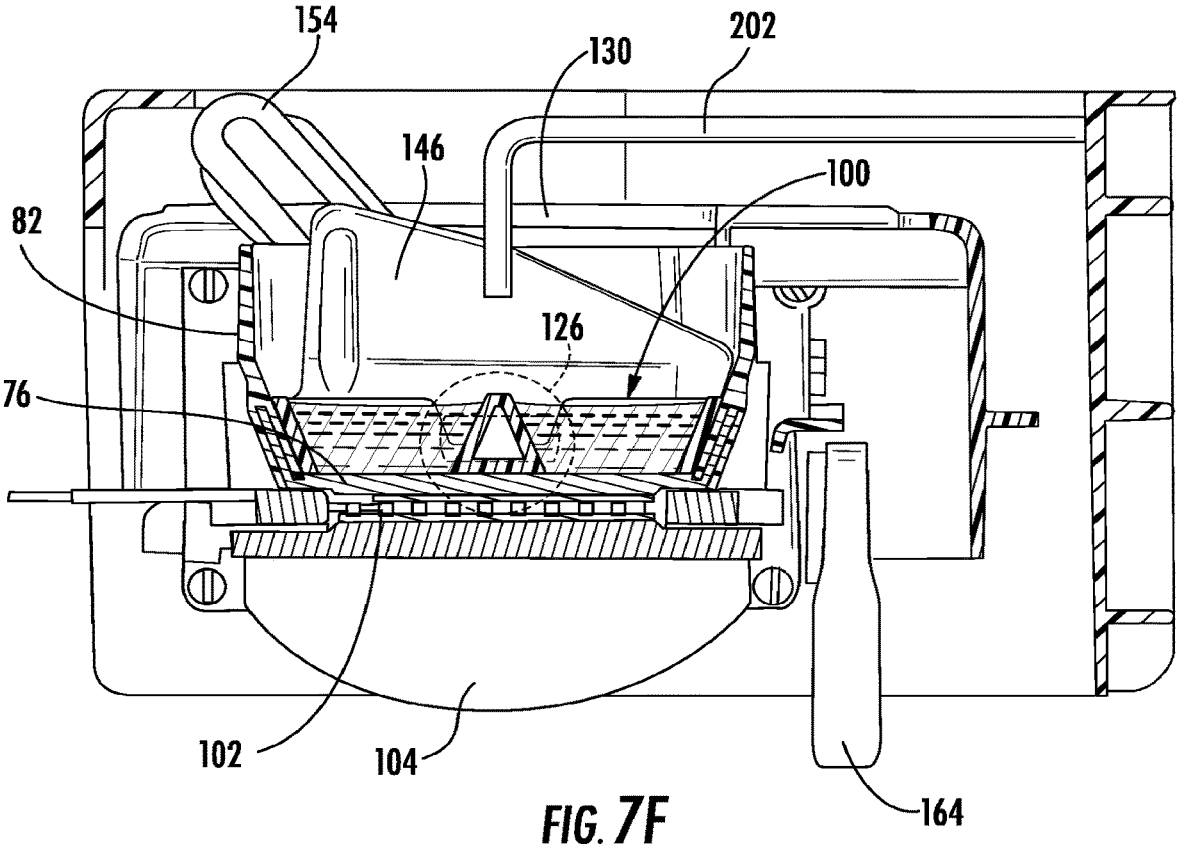
FIG. 7F is a cross sectional view of the ice maker of FIG. 7A, after completion of the freezing cycle.

FIGS. 7A-7F and FIGS. 12A-12B illustrate the ice making process of the ice maker 52. As shown in FIG. 7A, water is first dispensed into the ice tray 70. The thermoelectric cooler devices 102 are actuated and controlled to obtain a temperature less than freezing for the ice forming plate 76. One preferred temperature for the ice forming plate 76 is a temperature of from about −8° F. to about −15° F., but more typically the ice forming plate is at a temperature of about −12° F. At the same time, approximately the same time, or after a sufficient time to allow a thin layer of ice to form on the ice forming plate, the oscillating motor 112 is actuated to rotate the rocker frame 110 and ice cube tray 70 carried thereon in a clockwise direction, through an arc of from about 20° to about 40°, and preferably about 30°. The rotation also may be reciprocal at an angle of about 40° to about 80°. The water in the compartments 96 spills over from one compartment 96 into an adjacent compartment 96 within the ice tray 70, as illustrated in FIG. 7C. The water may also be moved against the containment wall 82, 84 by the oscillating motion. Subsequently, the rocker frame is rotated in the opposite direction, as shown in FIG. 7D, such that the water spills from one compartment 96 into and over the adjacent compartment 96. The movement of water from compartment 96 to adjacent compartment 96 is continued until the water is frozen, as shown in FIGS. 7E and 7F.

As the water cascades over the median wall 84, air in the water is released, reducing the number of bubbles in the clear ice piece 98 formed. The rocking may also be configured to expose at least a portion of the top layer of the clear ice pieces 98 as the liquid water cascades to one side and then the other over the median wall 84, exposing the top surface of the ice pieces 98 to air above the ice tray. The water is also frozen in layers from the bottom (beginning adjacent the top surface 78 of the ice forming plate 76, which is cooled by the thermoelectric device 102) to the top, which permits air bubbles to escape as the ice is formed layer by layer, resulting in a clear ice piece 98.

As shown in FIGS. 8-11, to promote clear ice production, the temperature surrounding the ice tray 70 can also be controlled. As previously described, a thermoelectric device 102 is thermally coupled or otherwise thermally engaged to the bottom surface 80 of the ice forming plate 76 to cool the ice forming plate 76. In addition to the direct cooling of the ice forming plate 76, heat may be applied above the water contained in the ice tray 70, particularly when the ice tray 70 is being rocked, to cyclically expose the top surface of the clear ice pieces 98 being formed.

Figure 8:
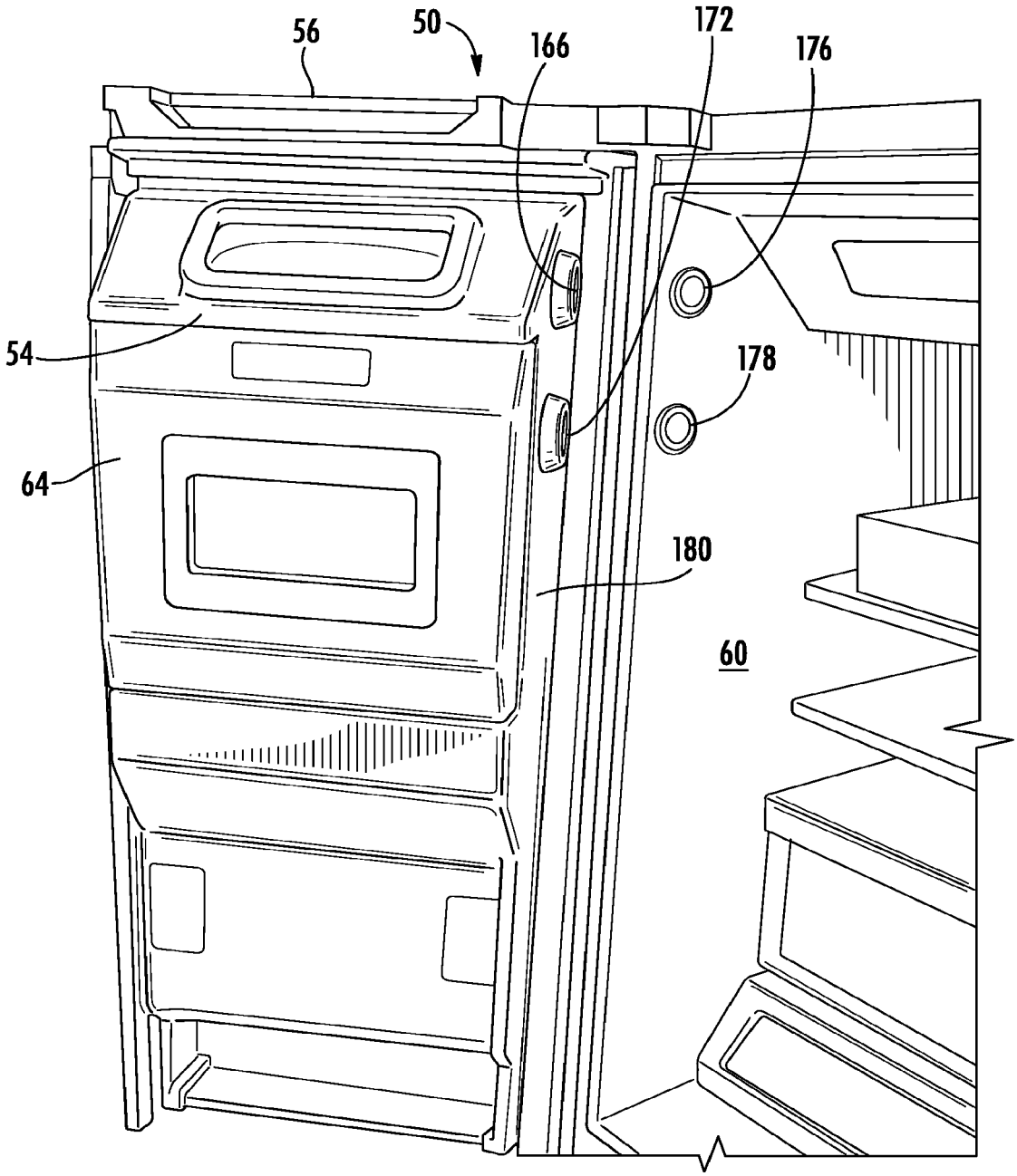
FIG. 8 is a perspective view of an appliance having an ice maker of the present invention and having air circulation ports.
Figure 9:
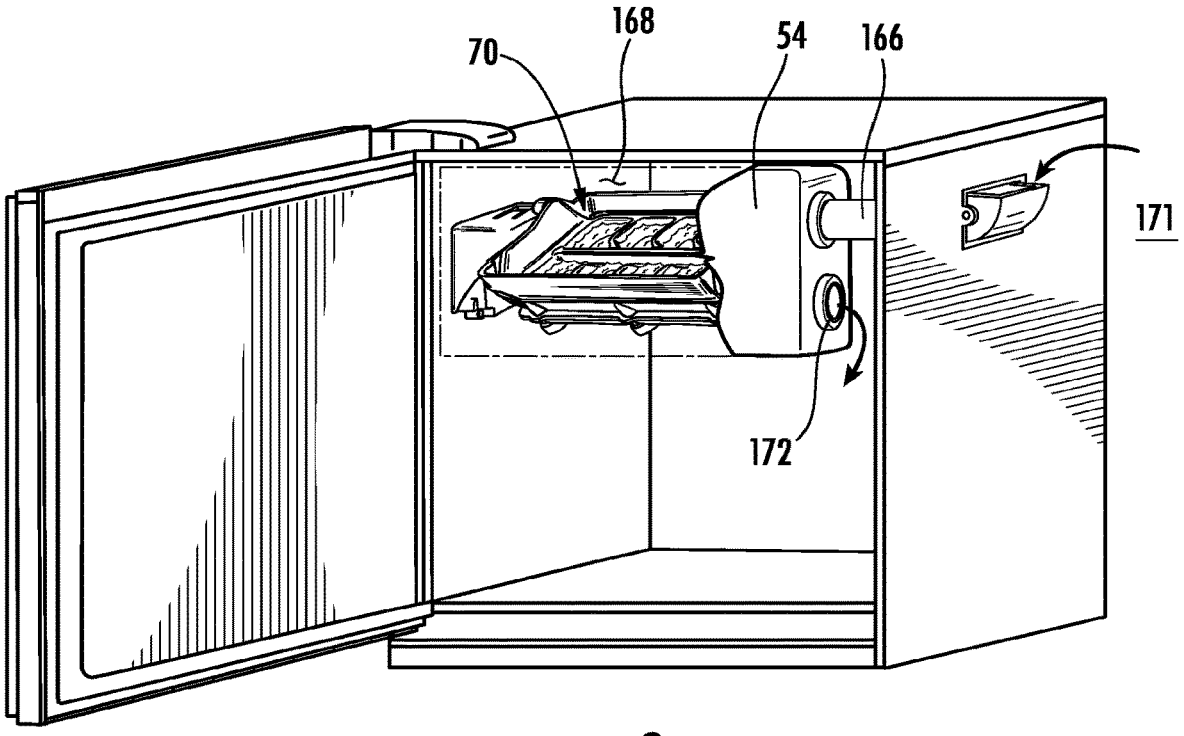
FIG. 9 is a top perspective view of an appliance having an ice maker of the present invention and having an ambient air circulation system.
Figure 10:
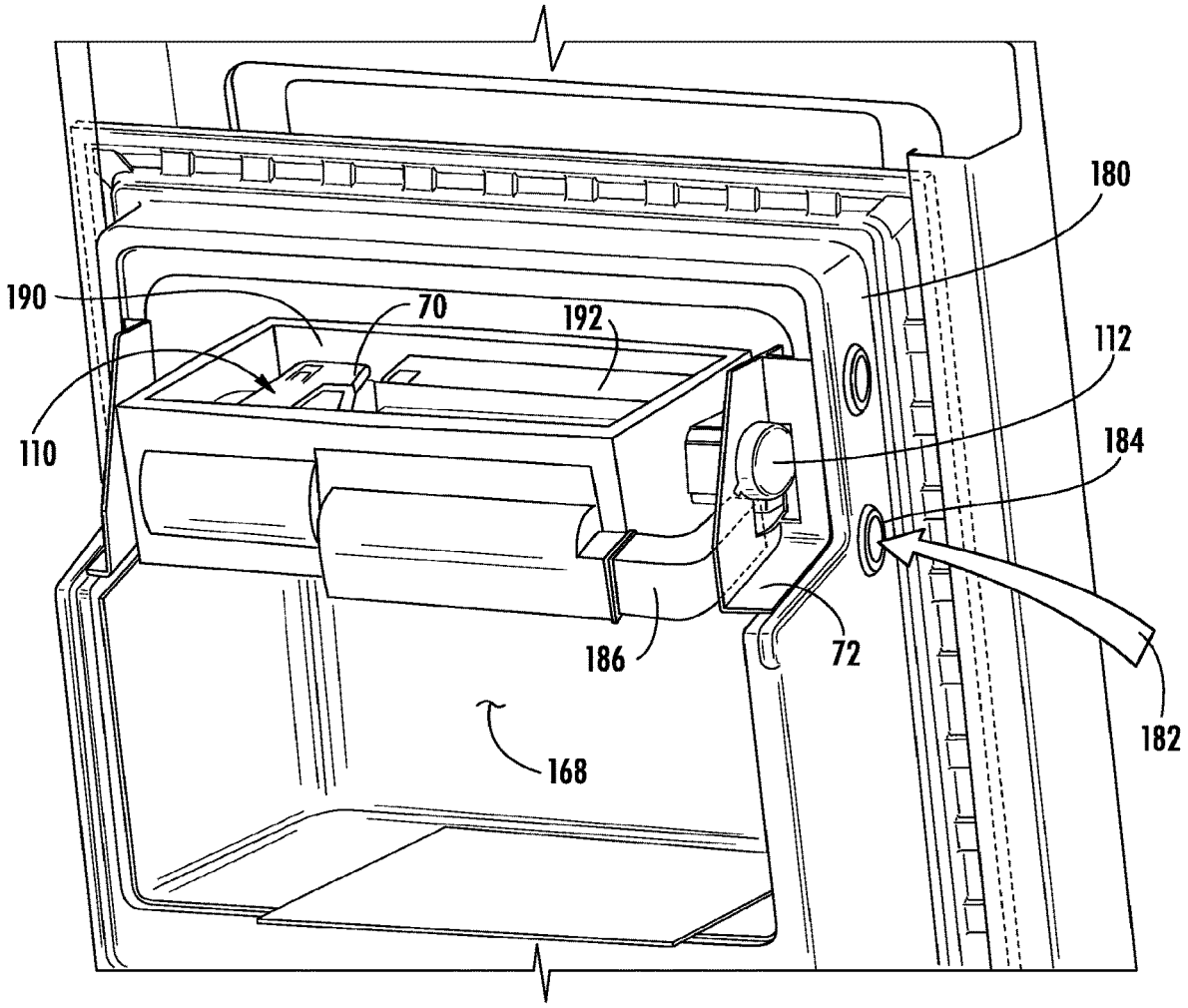
FIG. 10 is a top perspective view of an ice maker of the present invention installed in an appliance door and having a cold air circulation system.

As shown in FIGS. 8 and 9, heat may be applied via an air intake conduit 166, which is operably connected to an interior volume of the housing 168 above the ice tray 70. The air intake conduit 166 may allow the intake of warmer air 170 from a refrigerated compartment 60 or the ambient surroundings 171, and each of these sources of air 60, 171 provide air 170 which is warmer than the temperature of the ice forming plate 76. The warmer air 170 may be supplied over the ice tray 70 in a manner which is sufficient to cause agitation of the water retained within the ice tray 70, facilitating release of air from the water, or may have generally laminar flow which affects the temperature above the ice tray 70, but does not agitate the water therein. A warm air exhaust conduit 172, which also communicates with the interior volume 168 of the housing 54, may also be provided to allow warm air 170 to be circulated through the housing 54. The other end of the exhaust conduit 172 may communicate with the ambient air 171, or with a refrigerator compartment 60. As shown in FIG. 8, the warm air exhaust conduit 172 may be located below the intake conduit 166. To facilitate flow of the air 170, an air movement device 174 may be coupled to the intake or the exhaust conduits 166, 172. Also as shown in FIG. 8, when the housing 54 of the ice maker 52 is located in the door 56 of the appliance 50, the intake conduit 166 and exhaust conduit 172 may removably engage a corresponding inlet port 176 and outlet port 178 on an interior sidewall 180 of the appliance 50 when the appliance door 56 is closed.

Alternatively, the heat may be applied by a heating element (not shown) configured to supply heat to the interior volume 168 of the housing 54 above the ice tray 70. Applying heat from the top also encourages the formation of clear ice pieces 98 from the bottom up. The heat application may be deactivated when ice begins to form proximate the upper portion of the grid 100, so that the top portion of the clear ice pieces 98 freezes.

Additionally, as shown in FIGS. 8-11, to facilitate cooling of the ice forming plate 76, cold air 182 is supplied to the housing 54 below the bottom surface 80 of the ice forming plate 76. A cold air inlet 184 is operably connected to an intake duct 186 for the cold air 182, which is then directed across the bottom surface 80 of the ice forming plate 76. The cold air 182 is then exhausted on the opposite side of the ice forming plate 76.

Figure 11:
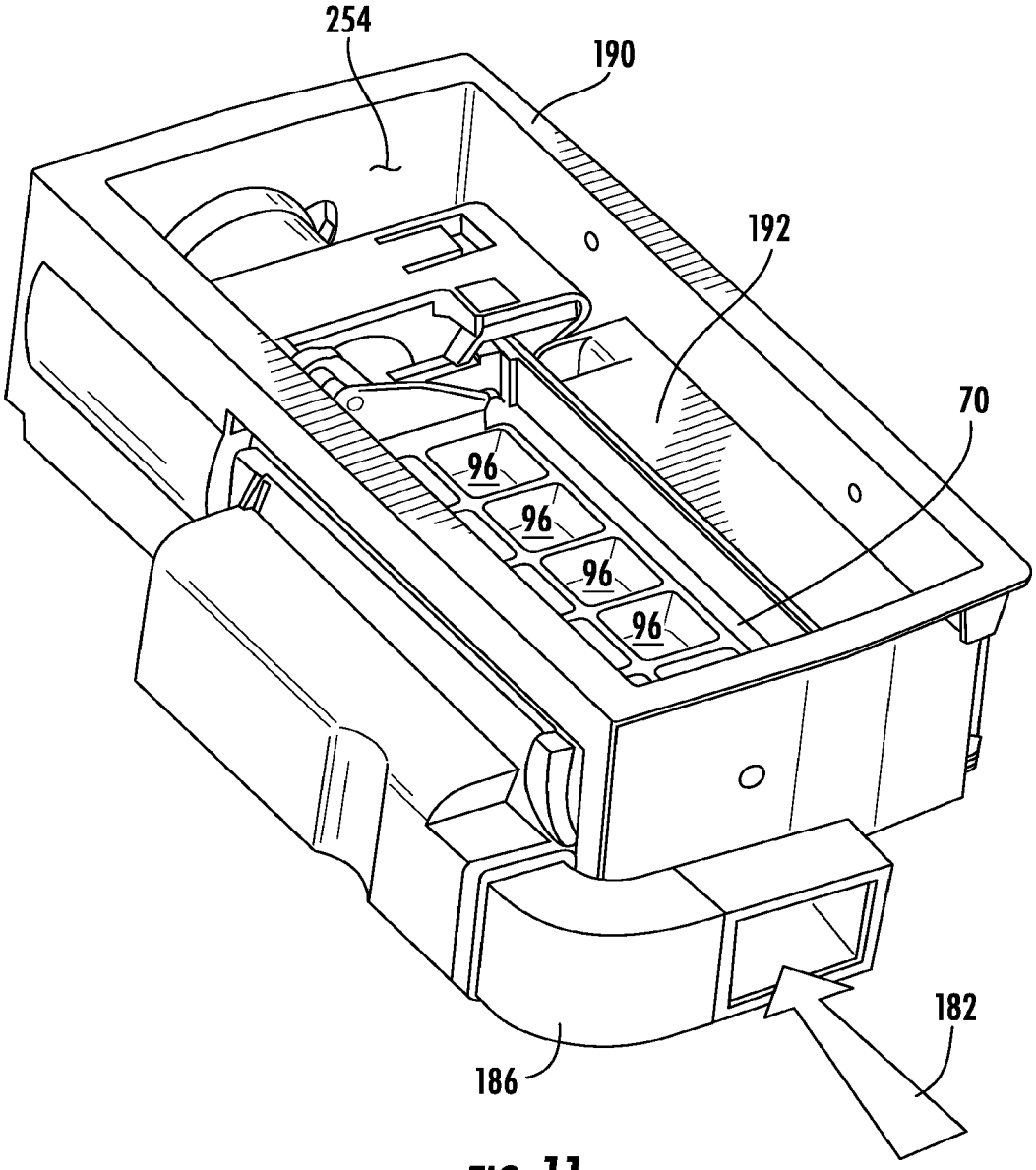
FIG. 11 is a top perspective view of an ice maker of the present invention, having a cold air circulation system.

As shown in FIG. 11, the ice maker is located within a case 190 (or the housing 54), and a barrier 192 may be used to seal the cold air 182 to the underside of the ice forming plate 76, and the warm air 170 to the area above the ice tray 70. The temperature gradient that is produced by supplying warm air 170 to the top of the ice tray 70 and cold air 182 below the ice tray 70 operates to encourage unidirectional formation of clear ice pieces 98, from the bottom toward the top, allowing the escape of air bubbles.

As shown in FIGS. 12A-12B, once clear ice pieces are formed, the ice maker 52, as described herein, harvests the clear ice pieces 98, expelling the clear ice pieces 98 from the ice tray 70 into the ice storage bin 64. To expel the ice 98, the harvest motor 114 is used to rotate the ice tray 70 and the grid 100 approximately 120°. This inverts the ice tray 70 sufficiently that a stop 116, 118 extending between the ice forming plate 76 and the rocker frame 110 prevents further movement of the ice forming plate 76 and containment walls 82. Continued rotation of the harvest motor 114 and arm 154 overcomes the tension of the spring clip 128 linkage, and as shown in FIG. 12B, the grid 100 is further rotated and twisted through an arc of about 40° while the arm 154 is driven by the harvest motor 114 and the cam pin 150 of the grid 100 slides along the slot 158 from the position shown in FIG. 12A to the position shown in FIG. 12B. This movement inverts and flexes the grid 100, and allows clear ice pieces 98 formed therein to drop from the grid 100 into an ice bin 64 positioned below the ice maker 52.

Once the clear ice pieces 98 have been dumped into the ice storage bin 64, the harvest motor 114 is reversed in direction, returning the ice tray 70 to a horizontal position within the rocker frame 110, which has remained in the neutral position throughout the turning of the harvest motor 114. Once returned to the horizontal starting position, an additional amount of water can be dispensed into the ice tray 70 to form an additional batch of clear ice pieces.

Figure 13:
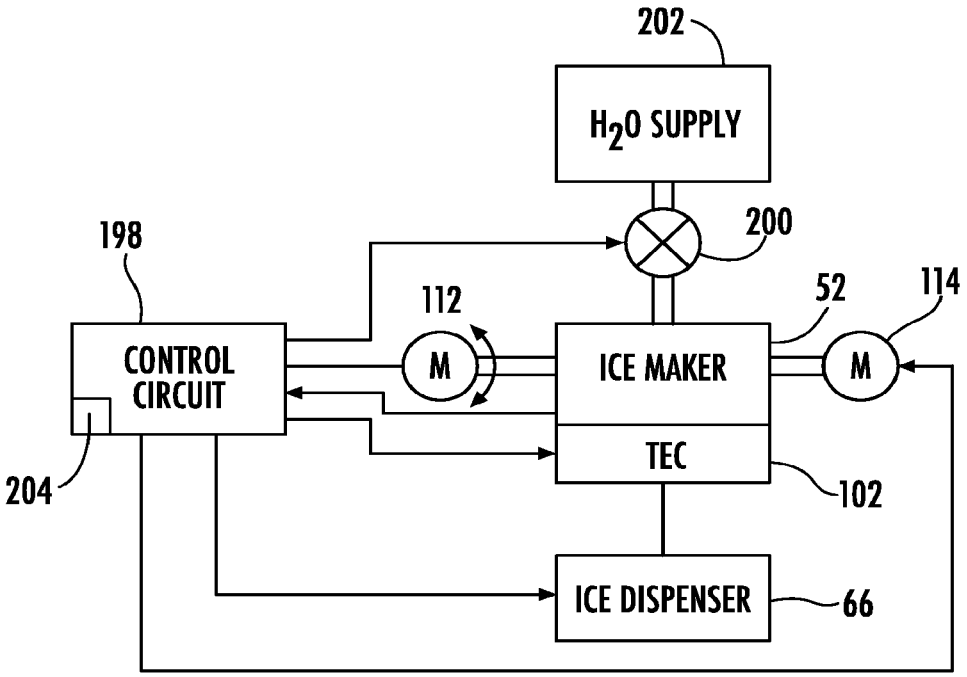
FIG. 13 is a circuit diagram for an ice maker of the present invention.

FIG. 13 depicts a control circuit 198 which is used to control the operation of the ice maker 52. The control circuit 198 is operably coupled to an electrically operated valve 200, which couples a water supply 202 and the ice maker 52. The water supply 202 may be a filtered water supply to improve the quality (taste and clarity for example) of clear ice piece 98 made by the ice maker 52, whether an external filter or one which is built into the refrigerator 50. The control circuit 198 is also operably coupled to the oscillation motor 112, which in one embodiment is a reversible pulse-controlled motor. The output drive shaft 136 of the oscillating motor 112 is coupled to the ice maker 52, as described above. The drive shaft 136 rotates in alternating directions during the freezing of water in the ice maker 52. The control circuit 198 is also operably connected to the thermoelectric device 102, such as a Peltier-type thermoelectric cooler in the form of thermoelectric plates. The control circuit 198 is also coupled to the harvest motor 114, which inverts the ice tray 70 and twists the grid 100 to expel the clear ice pieces 98 into the ice bin 64.

The control circuit 198 includes a microprocessor 204 which receives temperature signals from the ice maker 52 in a conventional manner by one or more thermal sensors (not shown) positioned within the ice maker 52 and operably coupled to the control circuit 198. The microprocessor 204 is programmed to control the water dispensing valve 200, the oscillating motor 112, and the thermoelectric device 102 such that the arc of rotation of the ice tray 70 and the frequency of rotation is controlled to assure that water is transferred from one individual compartment 96 to an adjacent compartment 96 throughout the freezing process at a speed which is harmonically related to the motion of the water in the freezer compartments 96.

The water dispensing valve 200 is actuated by the control circuit 198 to add a predetermined amount of water to the ice tray 70, such that the ice tray 70 is filled to a specified level. This can be accomplished by controlling either the period of time that the valve 200 is opened to a predetermined flow rate or by providing a flow meter to measure the amount of water dispensed.

The controller 198 directs the frequency of oscillation ω to a frequency which is harmonically related to the motion of the water in the compartments 96, and preferably which is substantially equal to the natural frequency of the motion of the water in the ice trays 70, which in one embodiment was about 0.4 to 0.5 cycles per second. The rotational speed of the oscillating motor 112 is inversely related to the width of the individual compartments 96, as the width of the compartments 96 influences the motion of the water from one compartment to the adjacent compartment. Therefore, adjustments to the width of the ice tray 70 or the number or size of compartments 96 may require an adjustment of the oscillating motor 112 to a new frequency of oscillation ω.

Figure 14:
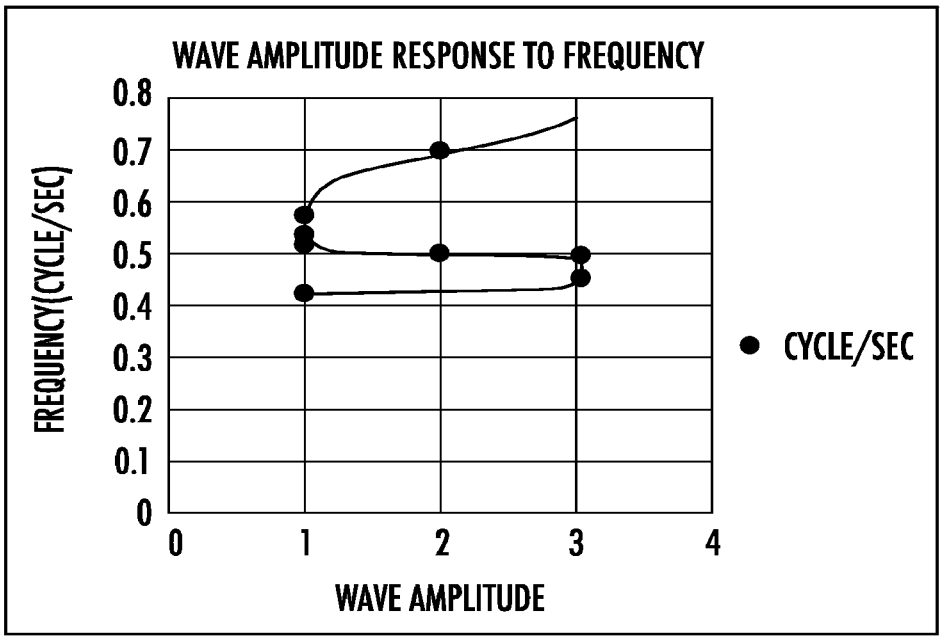
FIG. 14 is a graph of the wave amplitude response to frequency an ice maker of the present invention.

The waveform diagram of FIG. 14 illustrates the amplitude of the waves in the individual compartments 96 versus the frequency of oscillation provided by the oscillating motor 112. In FIG. 14 it is seen that the natural frequency of the water provides the highest amplitude. A second harmonic of the frequency provides a similarly high amplitude of water movement. It is most efficient to have the amplitude of water movement at least approximate the natural frequency of the water as it moves from one side of the mold to another. The movement of water from one individual compartment 96 to the adjacent compartment 96 is continued until the thermal sensor positioned in the ice tray 70 at a suitable location and operably coupled to the control circuit 198 indicates that the water in the compartment 96 is frozen.

After the freezing process, the voltage supplied to the thermoelectric device 102 may optionally be reversed, to heat the ice forming plate 76 to a temperature above freezing, freeing the clear ice pieces 98 from the top surface 78 of the ice forming plate 76 by melting a portion of the clear ice piece 98 immediately adjacent the top surface 78 of the ice forming plate 76. This allows for easier harvesting of the clear ice pieces 98. In the embodiment described herein and depicted in FIG. 13, each cycle of freezing and harvesting takes approximately 30 minutes.

The grid 100 is shaped to permit harvesting of clear ice pieces 98. The individual compartments 96, defined by the grid 100, diverge outwardly to form ice pieces 98 having a larger upper surface area than lower surface area. Typically, the median wall 84, edge wall 95, and dividing walls 94, which together define the ice compartment 96, have a draft angle α of from about 17° to about 25° from vertical when the ice forming plate 76 is in the neutral position to facilitate harvesting of ice pieces 98.

Figure 15:
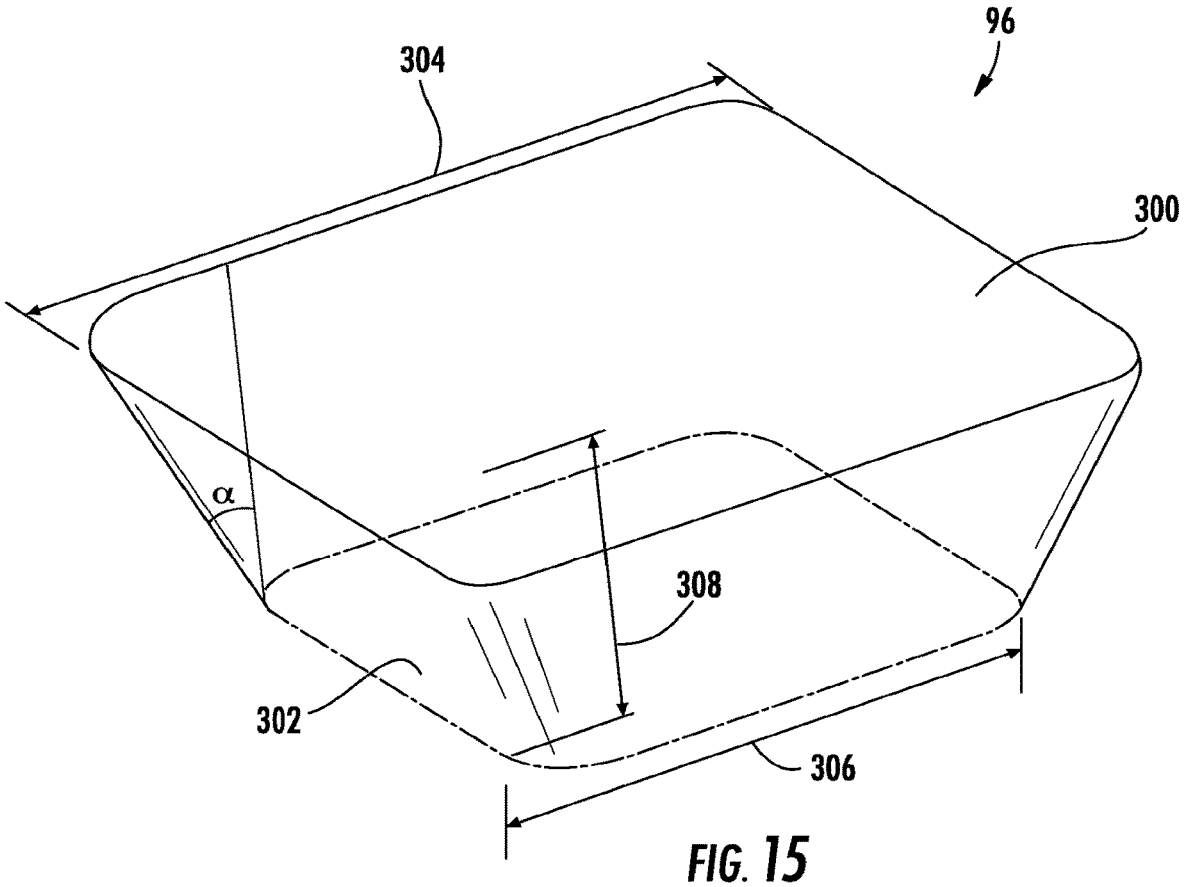
FIG. 15 is a top perspective view of an interior surface of an ice compartment of the present invention.
Figure 16:
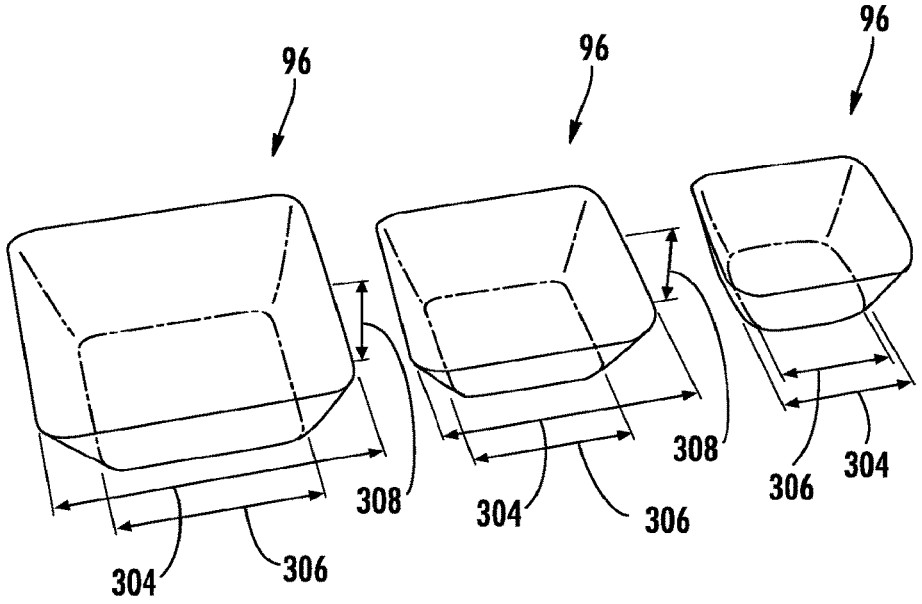
FIG. 16 is a top perspective view of the interior surface of different embodiments of an ice compartment of the present invention.
Figure 17:
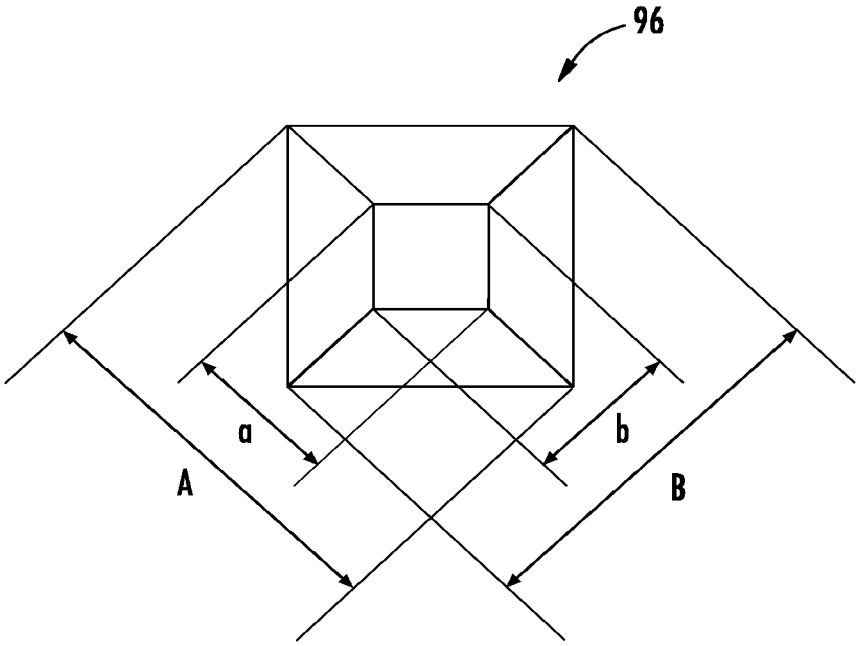
FIG. 17 is top plan view of an interior surface of an ice compartment of the present invention.

As shown in the embodiments depicted in FIGS. 15-17, compartments 96 have a generally square upper surface 300 and a generally square lower surface 302. The upper surface has a length 304 which is greater than the length 306 of the lower surface 302. The ice compartments 96 also have a height 308.

During the freezing process, when the grid 100 is in the neutral position, the diagonal length A of the upper surface 300 is about equal to the opposing diagonal length B of the upper surface 300, as shown in FIG. 17. Similarly, the diagonal length a of the lower surface 302 is about equal to the opposing diagonal length b of the lower surface 302. However, during the twisting of the grid 100 that is performed to harvest the ice pieces 98, the diagonal length A is lengthened, and the diagonal length B is shortened. Diagonal length a is also lengthened, and diagonal length b shortened, with the amount of change dependent on the twist angle and the height 308 of the individual compartment. This, combined with the draft angle α of the grid 100 results in lift during harvest, which frees the clear ice piece 98 from the individual compartment 96. The dimensions of the individual compartment 96 and the degree of twist are selected to create enough lift to release the ice piece 98 from the individual compartment, while minimizing the change in diagonal length a and diagonal length b during the twist. This increases twist reliability at the interface of the grid 100 and the top surface 78 of the ice forming plate 76, and reduces stress at the bottom of the ice piece 98. Reducing stress at the bottom of each cube is particularly helpful for grid 100 designs having a complex geometry or material composition that is susceptible to fatigue.

In one aspect, the upper surface 300 has a length 304 which is from about 1.4 times to about 1.7 times the length 306 of the lower surface 302. In another aspect, the length 304 of the upper surface 300 is about 1.5 to about 4 times the height 308 of the compartment 96. In another aspect, the length 306 of the lower surface 302 is about 1 to about 2 times the height 308 of the compartment 96.

In one example, the individual compartment has a generally square lower surface 302 with a length 306 of about 20 mm, a generally square upper surface 300 with a length 304 of about 29 mm, a height 308 of about 13 mm, and a draft angle $\alpha$ of about 20°. In another example, the ice compartment 96 includes a generally square lower surface 302 having a length 306 of about 16 mm, a generally square upper surface 300 with a length 304 of about 24 mm, a height 308 of about 10 mm, and a draft angle $\alpha$ of about 20°. In another example, the individual compartment 96 has a generally square lower surface 302 with a length 306 of about 13 mm, a generally square upper surface 300 having a length 304 of about 19 mm, and a draft angle $\alpha$ of about 20°. In another example, the individual compartment 96 has a generally rectangular upper surface 300 with a length 304 of about 40 mm and a width 310 of approximately 18 mm, and has a height 308 of about 12 mm and a generally semicircle shaped lower surface 302.

Typically, the compartment 96 has a lower surface 302 with a smaller surface area than upper surface 300. Typically, the lower surface 302 and upper surface 300 are generally square in shape, but may be of any other shape desired when making ice.

It will be understood by one having ordinary skill in the art that construction of the described invention and other components is not limited to any specific material. Other exemplary embodiments of the invention disclosed herein may be formed from a wide variety of materials, unless described otherwise herein. In this specification and the amended claims, the singular forms "a," "an," and "the" include plural reference unless the context clearly dictates otherwise.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An ice maker comprising:

an ice forming plate having a top surface; and a flexible grid without a bottom, the flexible grid having a median wall, a first dividing wall, a second dividing wall opposite the first dividing wall, an edge wall opposite the median wall, a first end, and a second end opposite the first end;

the flexible grid further having a first position mating with the top surface of the ice forming plate to form an individual compartment configured to receive liquid water and form an ice piece, wherein the individual compartment comprises a bottom and sides, with (i) the ice forming plate defining the bottom of the individual compartment and (ii) the median wall, the first dividing wall, the second dividing wall, and the edge wall of the flexible grid defining the sides of the individual compartment, the individual compartment having a diagonal length and an opposing diagonal length; and the flexible grid further having a second position wherein the second end of the flexible grid is rotated relative to the first position such that the flexible grid is twisted, the diagonal length of the individual compartment is lengthened, the opposing diagonal length of the individual compartment is shortened, and at least a section of the second end of the flexible grid is separated from the top surface of the ice forming plate.

2. The ice maker of claim 1, wherein while rotating to the second position from the first position, the second end of the flexible grid is rotated through an arc of 40 degrees relative to the first position.

3. The ice maker of claim 1 further comprising a thermoelectric device thermally connected to a bottom surface of the ice forming plate, wherein the thermoelectric device is a Peltier-type thermoelectric device.

4. The ice maker of claim 1, wherein the median wall, the edge wall, the first dividing wall, and the second dividing wall each have a draft angle of from 17 degrees to 25 degrees from vertical when the ice forming plate is in a neutral position and the flexible grid is in the first position.

5. The ice maker of claim 1, wherein the individual compartment has a height of 9 mm to 14 mm.

* * * * *